US009058930B2

(12) United States Patent
Muto

(10) Patent No.: US 9,058,930 B2
(45) Date of Patent: Jun. 16, 2015

(54) MULTIPLE WINDING APPARATUS AND MULTIPLE WINDING METHOD FOR COIL

(71) Applicant: NITTOKU ENGINEERING CO., LTD., Saitama (JP)

(72) Inventor: Kenichi Muto, Fukushima (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 169 days.

(21) Appl. No.: 13/762,781

(22) Filed: Feb. 8, 2013

(65) Prior Publication Data

US 2013/0206893 A1 Aug. 15, 2013

(30) Foreign Application Priority Data

Feb. 9, 2012 (JP) ..... 2012-025628

(51) Int. Cl.
*B21C 47/02* (2006.01)
*B65H 81/06* (2006.01)
*H01F 41/06* (2006.01)

(52) U.S. Cl.
CPC ..... *H01F 41/0645* (2013.01); *H01F 41/0637* (2013.01)

(58) Field of Classification Search
USPC ..... 242/439, 439.1, 440, 440.1, 444, 448
See application file for complete search history.

(56) References Cited

U.S. PATENT DOCUMENTS

| | | | | |
|---|---|---|---|---|
| 4,448,015 | A * | 5/1984 | Usui | 242/441.3 |
| 4,928,894 | A * | 5/1990 | Ohno et al. | 242/440.1 |
| 2009/0219126 | A1 | 9/2009 | Goto et al. | |

FOREIGN PATENT DOCUMENTS

| | | | |
|---|---|---|---|
| CN | 101110335 | B | 5/2010 |
| CN | 101836273 | A | 9/2010 |
| JP | 11-297559 | A | 10/1999 |
| JP | 2001-267171 | A | 9/2001 |
| JP | 2003-173913 | A | 6/2003 |
| JP | 2010-135710 | A | 6/2010 |

OTHER PUBLICATIONS

Extended European Search Report corresponding to 13154565.9, dated Jul. 24, 2013.

Office Action issued Feb. 15, 2015, corresponding to Chinese patent application No. 201310050809.0.

* cited by examiner

*Primary Examiner* — Emmanuel M Marcelo

(74) *Attorney, Agent, or Firm* — Lowe Hauptman & Ham, LLP

(57) ABSTRACT

The multiple winding apparatus for coil includes a winding core, a spindle shaft on a tip end of which the winding core is removably mounted and which rotates together with the winding core, a wire rod feeding flyer which feeds a wire rod while rotating around the winding core mounted on the spindle shaft, a winding core removal mechanism which removes the winding core from the spindle shaft by moving the winding core in an axial direction, a supporting member which faces the spindle shaft and supports a plurality of the winding cores removed by the winding core removal mechanism at desired intervals in the axial direction, and a support member moving mechanism which moves the supporting member supporting the winding cores from a position facing the spindle shaft in a direction away from the spindle shaft.

10 Claims, 26 Drawing Sheets

MULTIPLE WINDING APPARATUS AND MULTIPLE WINDING METHOD FOR COIL

TECHNICAL FIELD

The present invention relates to a multiple winding apparatus and a multiple winding method for coil for continuously forming coils by so-called alpha winding such that the start and the end of a wire rod are both on the outer periphery (α-winding coils).

DESCRIPTION OF RELATED ART

Conventionally, in the case of manufacturing a multiple-winding coil in which α-winding coils are connected, individual α-winding coils are manufactured and lead wires of these are connected, such as by soldering to form a multiple coil. However, in recent years, it has been required to form a plurality of such α-winding coils in a connected state. Thus, the present applicant has proposed a multiple winding apparatus for coil which includes a spindle mechanism which houses a plurality of parallelly arranged spindles rotatable about an axial center, a spindle moving mechanism which moves the spindle mechanism in a direction substantially perpendicular to spindle shafts, winding cores which are held on the respective spindles, a wire rod supply unit which rotates around the winding core and feeds a wire rod, a wire rod holding unit which holds the wire rod fed from the wire rod supply unit and a wire rod pull-out unit which pulls out the wire rod fed from the wire rod holding unit in a direction perpendicular to the spindles (see JP2010-135710A).

In this multiple winding apparatus, the wire rod fed from the wire rod supply unit is held by the wire rod holding unit, the wire rod between the wire rod holding unit and the wire rod supply unit is pulled out a predetermined length by the wire rod pull-out unit, the pulled-out wire rod is wound on the winding core by rotating the winding core, and a coil is formed by rotating the wire rod supply unit in the same direction as the rotation direction of the winding core at a speed not slower than the rotation speed of the winding core. Thereafter, a new spindle is moved toward the wire rod supply unit by the spindle moving mechanism, the wire rod between an end lead of the wound coil and the wire rod supply unit is pulled out the predetermined length by the wire rod pull-out unit, the pulled-out wire rod is wound on the winding core by rotating the winding core, and a connected coil is formed by rotating the wire rod supply unit in the same direction as the rotation direction of the winding core at a speed not slower than the rotation speed of the winding core. A multiple-winding coil is formed by repeating the above operations thereafter.

SUMMARY OF THE INVENTION

However, since a larger number of spindle shafts than coils desired to be continuously obtained are parallelly arranged in the above conventional multiple winding apparatus, successive coils wound on the winding cores respectively mounted on a plurality of spindle shafts are connected by connecting wires having a length equal to an interval between the spindle shafts. Thus, the length of the connecting wires is determined by the interval between the spindle shafts, which has made it difficult to adjust the lengths of the connecting wires.

Further, in the above conventional multiple winding apparatus, the interval between the plurality of spindle shafts provided in parallel is made larger than the outer diameter of the coils to be obtained due to necessity to avoid interference with adjacent coils. Thus, the length of the connecting wires connecting the coils is invariably longer than the outer diameter of the coils and it is not possible to obtain a plurality of coils connected by connecting wires shorter than the outer diameter of the coils.

An object of the present invention is to provide a multiple winding apparatus and a multiple winding method for coil capable of easily adjusting the length of connecting wires connecting a plurality of coils.

Another object of the present invention is to provide a multiple winding apparatus and a multiple winding method for coil capable of obtaining a plurality of coils connected by connecting wires shorter than the outer diameter of coils.

According to one aspect of this invention, a multiple winding apparatus for coil is provided. The multiple winding apparatus comprises a winding core, a spindle shaft on a tip end of which the winding core is removably mounted and which rotates together with the winding core, a wire rod feeding flyer which feeds a wire rod while rotating around the winding core mounted on the spindle shaft, a winding core removal mechanism which removes the winding core from the spindle shaft by moving the winding core in an axial direction, a supporting member which faces the spindle shaft and supports a plurality of the winding cores removed by the winding core removal mechanism at desired intervals in the axial direction, and a support member moving mechanism which moves the supporting member supporting the winding cores from a position facing the spindle shaft in a direction away from the spindle shaft.

According to another aspect of this invention, a multiple winding method for coil is provided. The multiple winding method comprises a first pull-out step of holding and pulling out a wire rod fed from a wire rod feeding flyer a predetermined length, a winding step of winding the pulled-out wire rod on a winding core by mounting the winding core on the tip end of a spindle shaft and rotating the winding core, an α-winding coil forming step of forming an α-winding coil by rotating the wire rod feeding flyer in the same direction as the winding core and winding the wire rod fed from the wire rod feeding flyer on the winding core, a removing step of removing the α-winding coil from the spindle shaft together with the winding core, and a second pull-out step of pulling out the wire rod the predetermined length anew from the wire rod feeding flyer by moving the winding core removed from the spindle shaft together with the α-winding coil, wherein the steps from the winding step to the second pull-out step are, thereafter, repeated, and the winding cores removed from the spindle shaft are successively supported at desired intervals on a supporting member facing the spindle shaft in the removing step.

PREFERRED EMBODIMENTS OF THE INVENTION

Next, an embodiment of the present invention is described with reference to the drawings.

Figure 10:
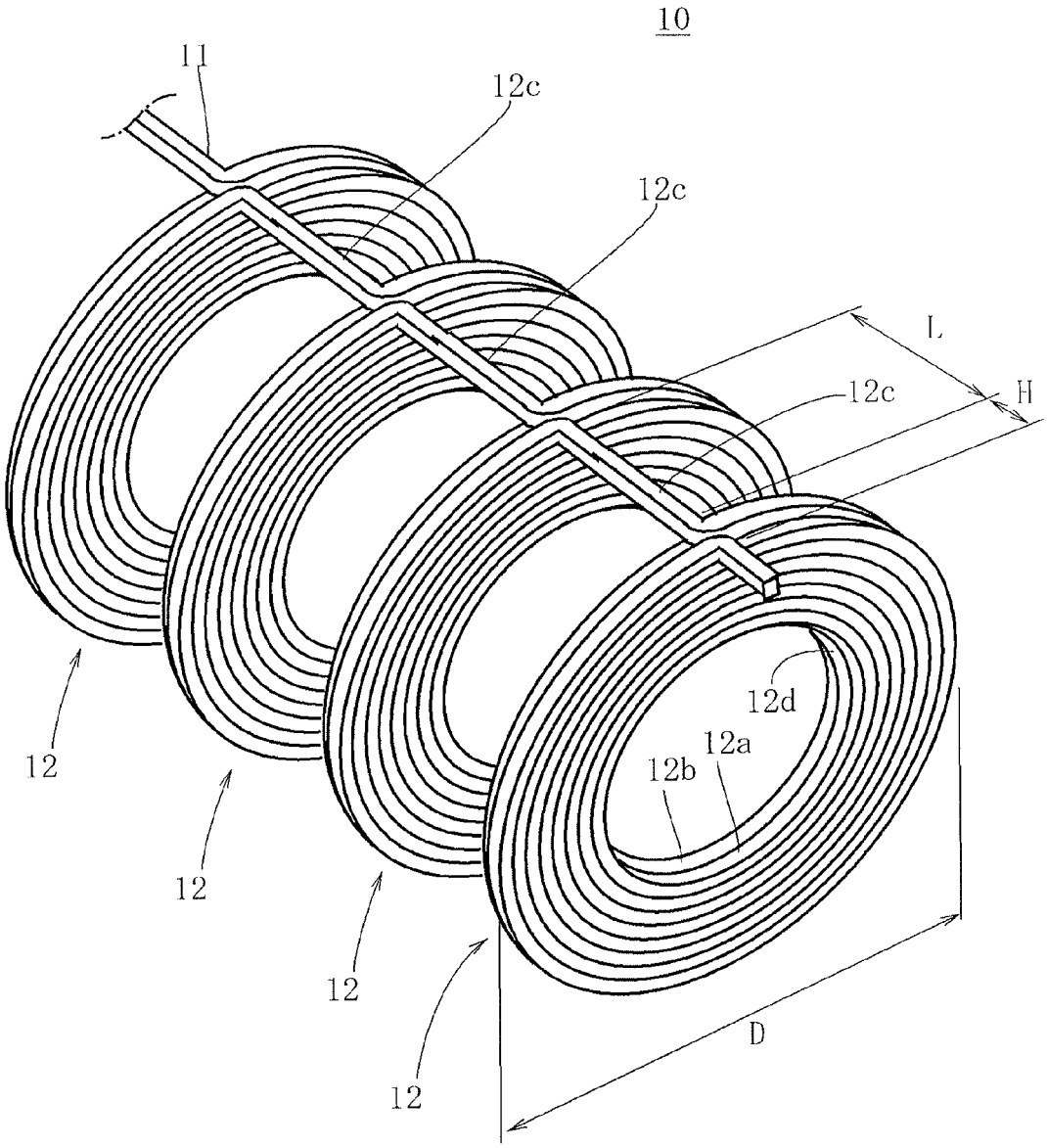
FIG. 10 is a perspective view of a multiple winding coil obtained by the multiple winding apparatus.

FIG. 10 shows a multiple winding coil 10 obtained by a multiple winding apparatus 20 according to the embodiment of the present invention. The multiple winding coil 10 is, for example, the one used as a motor coil for oil drilling and formed by connecting a plurality of so-called α-winding coils 12 in which the start and the end of a wire rod 11 obtained by winding the wire rod 11 are both on the outer periphery. The multiple winding coil 10 is provided in such that a plurality of the α-winding coils 12 is connected to each other by connecting wires 12*c* shorter than an outer diameter D of the α-winding coils 12. In this embodiment, the multiple winding coil 10 is illustrated in which a self-fusing wire (so-called cement wire) having a rectangular cross-section and including an insulation coating fusible by hot air or solvent is used as the wire rod 11 and four α-winding coils 12 are connected via the connecting wires 12*c*.

The single α-winding coil 12 is composed of first and second coils 12*a*, 12*b* in which the wire rod 11 is spirally wound and which are put together, and inner peripheral ends of these first and second coils 12*a*, 12*b* are connected by a connecting wire 12*d* at an inner side of the coils. Parts of the wire rod 11 adjacent in a winding direction in the first and second coils 12*a*, 12*b* are in contact with each other and the respective wire rods 11 of the first and second coils 12*a*, 12*b* are in contact with each other, thereby increasing a space factor of the wire rod 11 in the α-winding coil 12. The wire rod 11 at outer peripheral ends of the first and second coils 12*a*, 12*b* extending in a circumferential direction are bent to extend in an axial direction, and the wire rod 11 extending up to the adjacent α-winding coil 12 serves as the connecting wire 12*c* used to connect a plurality of α-winding coils 12.

The multiple winding apparatus 20 is shown in FIGS. 1 to 4. Here, three axes of X, Y and Z perpendicular to each other are set and the configuration of the multiple winding apparatus 20 is described, assuming that an X-axis extends substantially in a horizontal front-back direction, a Y-axis extends substantially in a horizontal lateral direction and a Z-axis extends substantially in a vertical direction.

The multiple winding apparatus 20 includes a winding core 21, a spindle shaft 31 on a tip end of which the winding core 21 is removably mounted and which rotates together with the winding core 21, and a wire rod feeding flyer 41 which feeds the wire rod while rotating around the winding core 21. A mounting plate 18 extending in a Y-axis direction stands on a horizontal mount 19, a circular plate 42 having a large diameter is rotatably mounted on the mounting plate 18 with a central axis thereof extending in an X-axis direction. The spindle shaft 31 extends in the X-axis direction through the center of the circular plate 42 and is relatively rotatable with respect to the circular plate 42.

The flyer 41 is provided on the circular plate 42 to project radially outward. Specifically, the flyer 41 includes a supporting piece 43 extending in a radial direction from the circular plate 42 on the front side of the mounting plate 18 and parallel to the mounting plate 18, a pair of projecting pieces 44 projecting from the projecting end of the supporting piece 43 in parallel to the spindle shaft 31, and a rotary supporting piece 46 extending radially outward from the projecting ends of the pair of projecting pieces 44. A rotary supporting member 47 for rotatably supporting a wire storage drum 13 on which the wire rod 11 is wound is provided on a side of the circular plate 42 opposite to a side where the flyer 41 is provided, i.e. on the circular plate 42 on the rear side of the mounting plate 18, and a communication hole (not shown) for guiding the wire rod 11 fed from the wire storage drum 13 to the flyer 41 is formed in the circular plate 42. A first turning pulley 48 for turning the wire rod 11 is rotationally supported on the rotary supporting piece 46 in the flyer 41 and a second turning pulley 49 for turning the wire rod 11 having passed through the unillustrated communication hole of the circular plate 42 toward the first turning pulley 48 is rotationally supported on a supporting piece 43 in the flyer 41 (FIG. 4).

Figure 3:
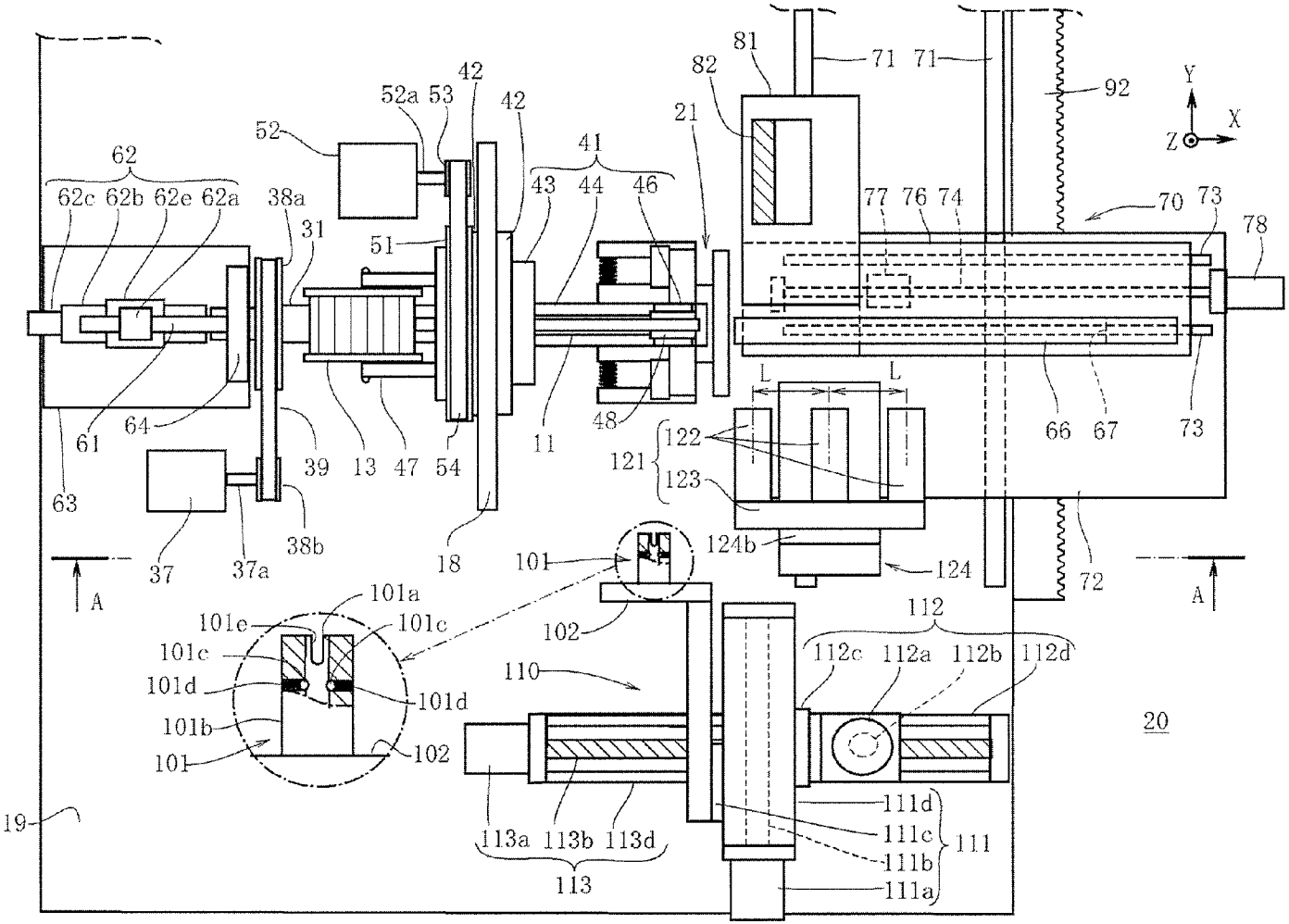
FIG. 3 is a front view showing the multiple winding apparatus.

In this way, the wire rod 11 fed from the wire storage drum 13 passes through the unillustrated communication hole of the circular plate 42, is turned by the second turning pulley 49, passes between the pair of projecting pieces 44 and is turned by the first turning pulley 48 to be guided to the winding core 21 to be described later. The rotary supporting piece 46 includes sandwiching pieces 46*a* for twisting the wire rod 11 turned by the first turning pulley 48 and moving toward the winding core 21 and sandwiching it from opposite sides in a thickness direction to applying resistance to the wire rod 11 and prevent the wire rod 11 from returning toward the first turning pulley 48 (FIG. 3). Further, pulleys 46*b* for turning the wire rod 11 having passed the sandwiching pieces 46*a* are provided in the rotary supporting piece 46 at opposite sides of the wire rod 11 to sandwich the wire rod 11 (FIG. 3).

Figure 4:
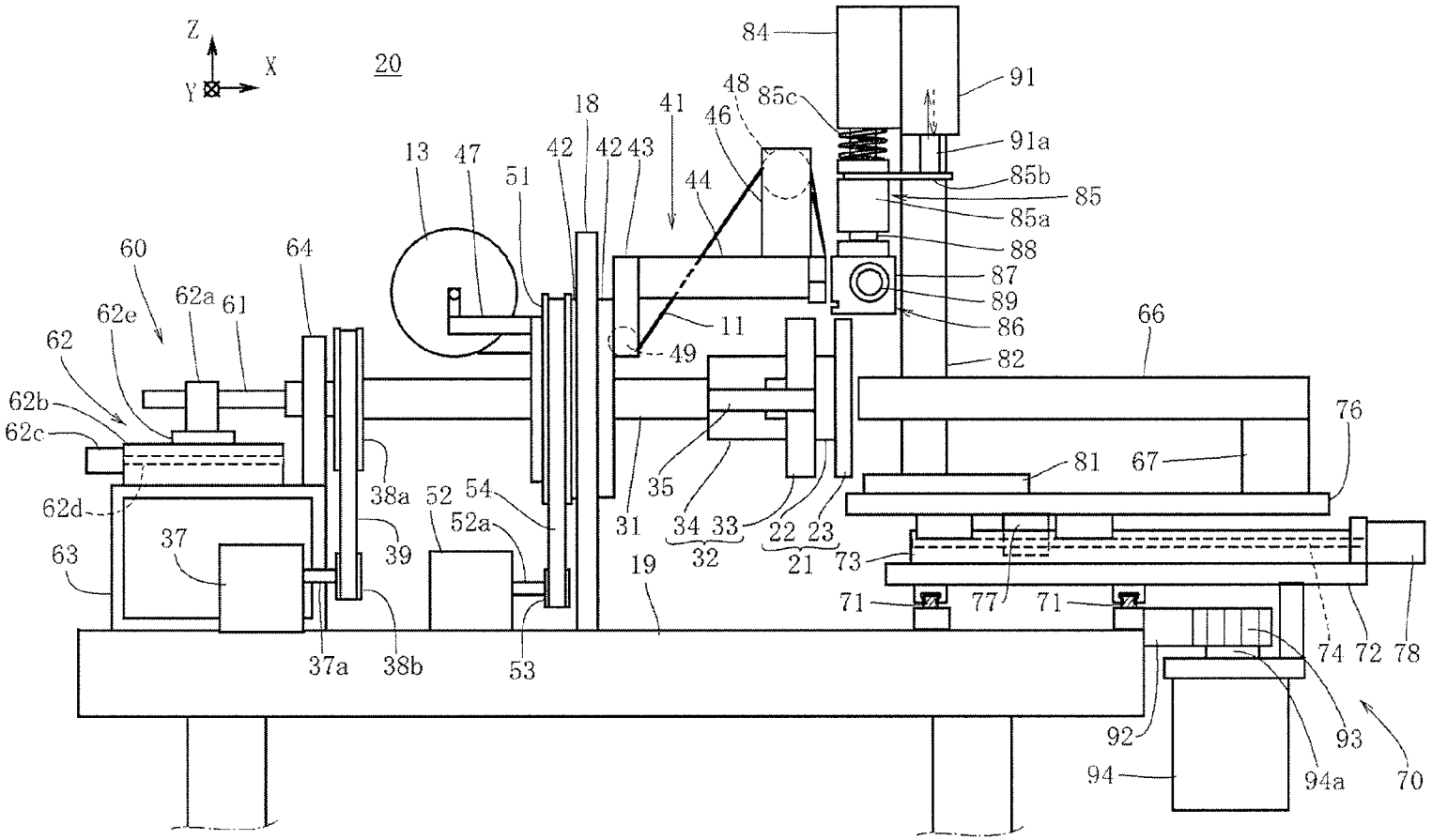
FIG. 4 is a sectional view along line A-A of FIG. 2 showing the multiple winding apparatus.

On the other hand, a rotary drive pulley 51 is provided on the circular plate 42 penetrating through the mounting plate 18 coaxially with the circular plate 42 on the rear side of the mounting plate 18 and a servo motor for flyer 52 for rotating the circular plate 42 together with the flyer 41 is mounted on the mount 19 (FIG. 4). A pulley 53 is provided on a rotary shaft 52*a* of the servo motor for flyer 52, and a belt 54 is mounted between the pulley 53 and the pulley 51 provided on the circular plate 42. In this way, when the servo motor for flyer 52 is driven to rotate the rotary shaft 52*a* thereof, that rotation is transmitted to the circular plate 42 via the belt 54 and the flyer 41 provided on the circular plate 42 rotates.

Figure 5:
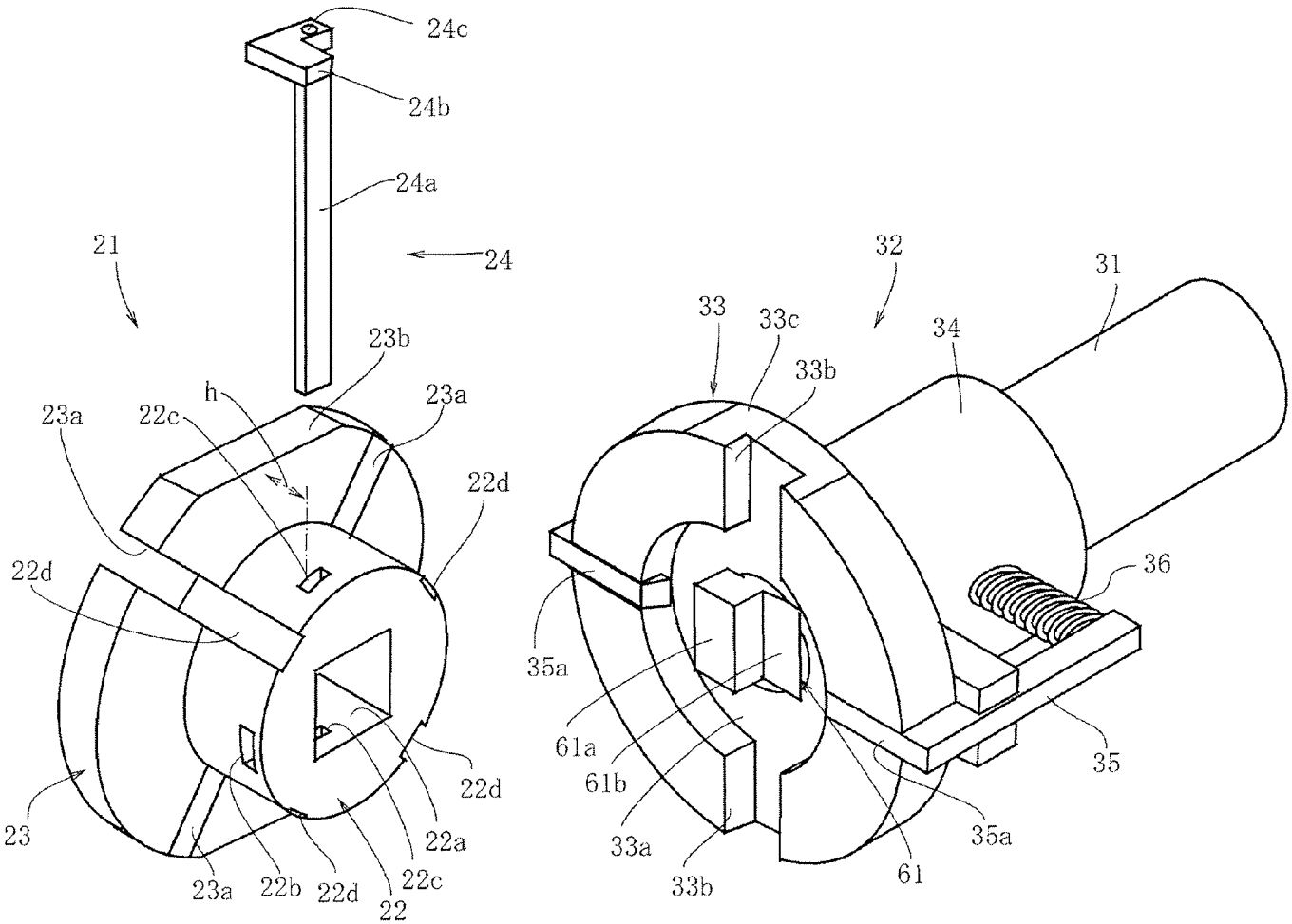
FIG. 5 is a perspective view showing a relationship between a spindle shaft and a winding core.

As shown in FIG. 5, the winding core 21 includes a core main body 22 one end of which is mounted to a mounting fixture 32 at the tip end of the spindle shaft 31 and on the outer periphery of which the wire rod 11 is to be wound, and a first flange portion 23 which is formed on the other end of the core main body 22 and with which one side of the α-winding coil 12 made of the wire rod 11 wound on the core main body 22 is held in contact. The core main body 22 is formed, for example, into a cylindrical shape corresponding to the inner shape of the α-winding coil 12, and the outer peripheral shape thereof is equal to the inner peripheral shape of the α-winding coil 12 (FIG. 10) desired to be obtained in order to form the multiple winding coil 10 by taking up the wire rod 11. Further, a through hole 22*a* through which a push-out bar 61 to be described later is insertable and which has, for example, a rectangular cross-section is formed along a central axis of the core main body 22, and locking holes 22*b* in which locking claws 35*a* to be described later are to be locked are formed on opposite sides of the core main body 22 in a direction perpendicular to the central axis of the core main body 22.

Figure 6:
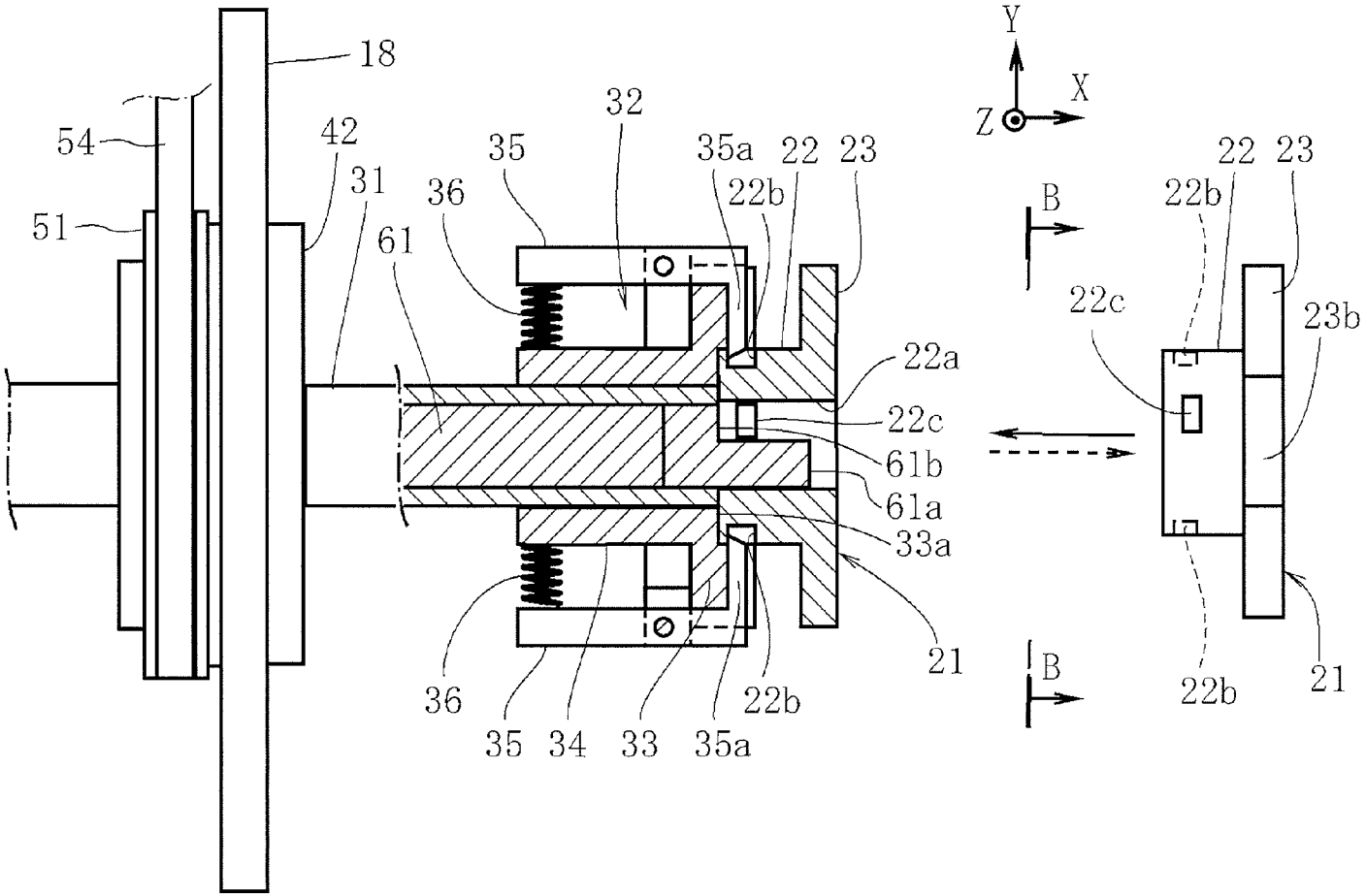
FIG. 6 is a partial sectional view showing the relationship between the spindle shaft and the winding core.

As shown in FIGS. 5 and 6, the mounting fixture 32 to which the winding core 21 is removably mounted is provided on the tip end of the spindle shaft 31 on the side where the flyer 41 is provided. The mounting fixture 32 includes a second flange portion 33 with which one widthwise side of the α-winding coil 12 (FIG. 10) made of the wire rod 11 wound on the core main body 22 of the winding core 21 is held in contact, and a tubular portion 34 used to mount the second flange portion 33 on the spindle shaft 31. The tubular portion 34 includes a pair of levers 35 parallel to the spindle shaft 31 at opposite sides of the second flange portion 33. Central parts of the pair of levers 35 are pivotally supported on the tubular portion 34. A bottomed round hole 33 into which the end of the core main body 22 is insertable is formed in a central part of the second flange portion 33.

The locking holes 22*b* extending from the outer side toward the center are respectively formed on the opposite sides of the one end side of the core main body 22 insertable into the round hole 33*a*. As shown in detail in FIG. 6, the locking claw 35*a* one end of which is locked in the locking hole 22*b* in a state where the one end of the core main body 22 is inserted in the round hole 33*a* and the tip end surface thereof is held in contact with the bottom surface of the round hole 33*a* is mounted on the tip end of each of the pair of levers 35. Coil springs 36 are interposed between the base ends of the pair of levers 35 and the tubular portion 34. The pair of levers 35 are biased in directions to bring the locking claws 35*a* provided on the tip ends closer to each other by biasing forces of the coil springs 36, and the locking claws 35*a* are locked in the locking holes 22*b*.

The winding core 21 is mounted on the tip end of the spindle shaft 31 by the locking claws 35*a* being locked in the locking holes 22*b*. In this state, a spacing between the first and second flange portions 23, 33 is slightly larger than winding width H (FIG. 10) of the α-winding coil 12 desired to be obtained. This enables the wire rod 11 to be wound on the core main body 22 held between the first and second flange portions 23, 33. On the other hand, if the tip ends of the pair of levers 35 are brought away from each other against the biasing forces of the coil springs 36, the locking claws 35*a* come out from the locking holes 22*b*, wherefore the winding core 21 can be removed from the tip end of the spindle shaft 31.

Figure 7:
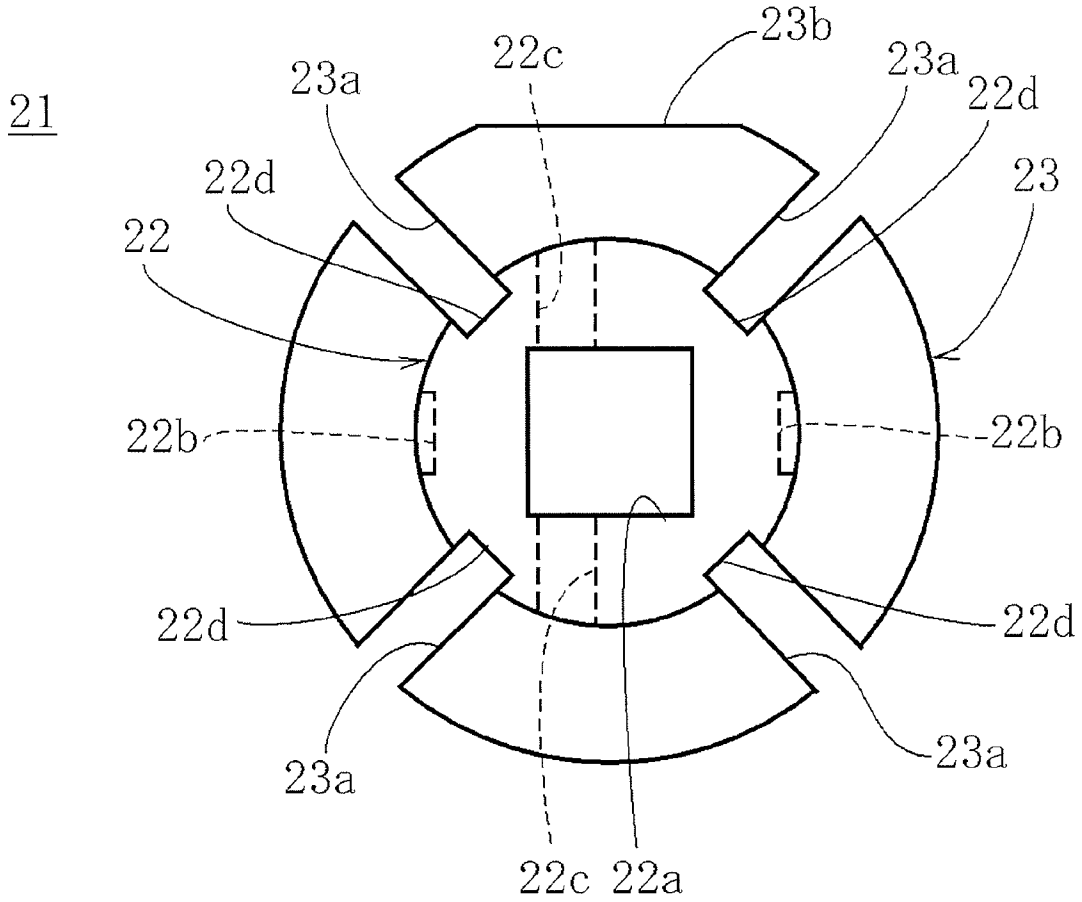
FIG. 7 is a sectional view along line B-B of FIG. 6.
Figure 9:
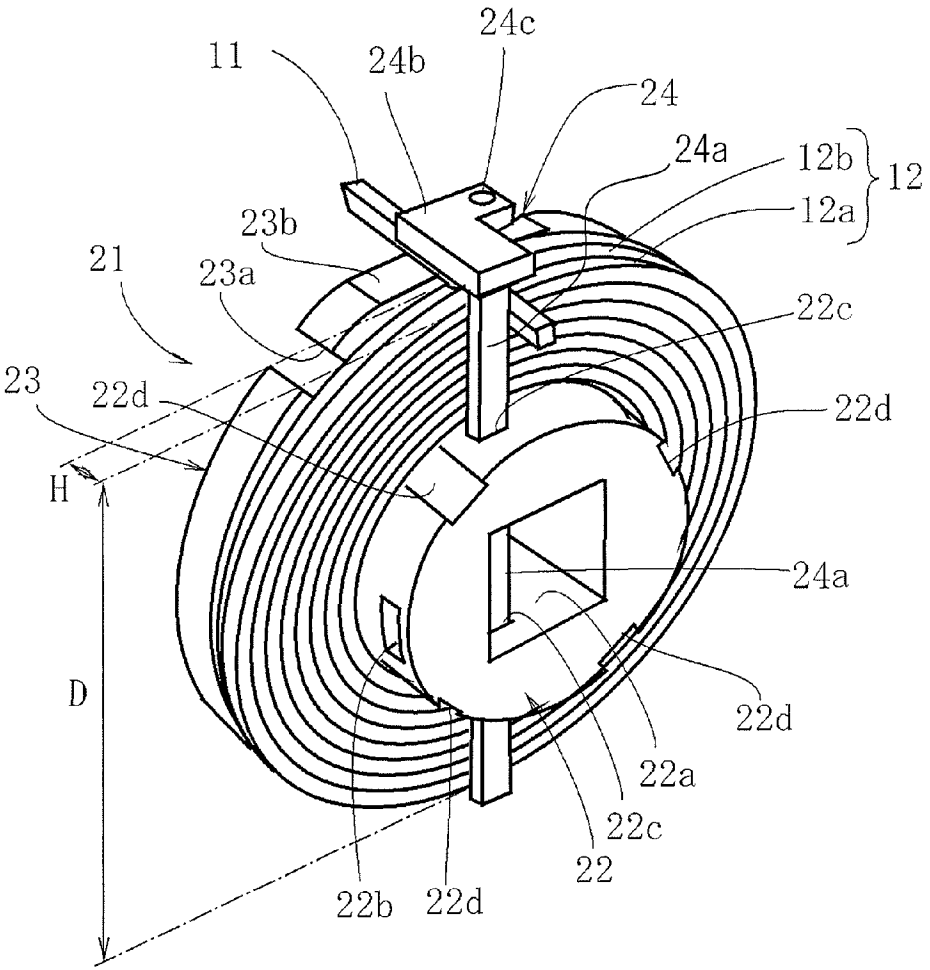
FIG. 9 is a perspective view showing a state where the collapse of an α-winding coil obtained by winding a wire rod on the winding core is prevented by a pressing member.

As shown in FIGS. 5, 7 and 9, a part of the core main body 22 of the winding core 21 to be inserted into the round hole 33*a* is formed with an insertion hole 22*c* perpendicular to the axial direction at a position displaced from the center. As shown in FIG. 5, a distance h from the insertion hole 22*c* to the first flange portion 23 is slightly longer than the winding width H (FIG. 10) of the α-winding coil 12 desired to be obtained. The insertion hole 22*c* is formed to have a rectangular cross-section. A pressing member 24 is inserted into the insertion hole 22*c*. The pressing member 24 is held in contact with one widthwise side of the α-winding coil 12 made of the wire rod 11 wound on the core main body 22 in a state inserted through the insertion hole 22*c*. The pressing member 24 includes an insertion bar 24*a* having a rectangular cross-section and to be inserted through the insertion hole 22*c*, a plate member 24*b* one end of which is mounted on the base end of the insertion bar 24*a* and the other end of which faces the outer periphery of the first flange portion 23 in the state where the insertion bar 24*a* is inserted through the insertion hole 22*c*, and a pin 24*c* which is provided on the other end of the plate member 24*b* facing the outer periphery of the first flange portion 23 and directly held in contact with the outer periphery of the first flange portion 23.

Figure 20:
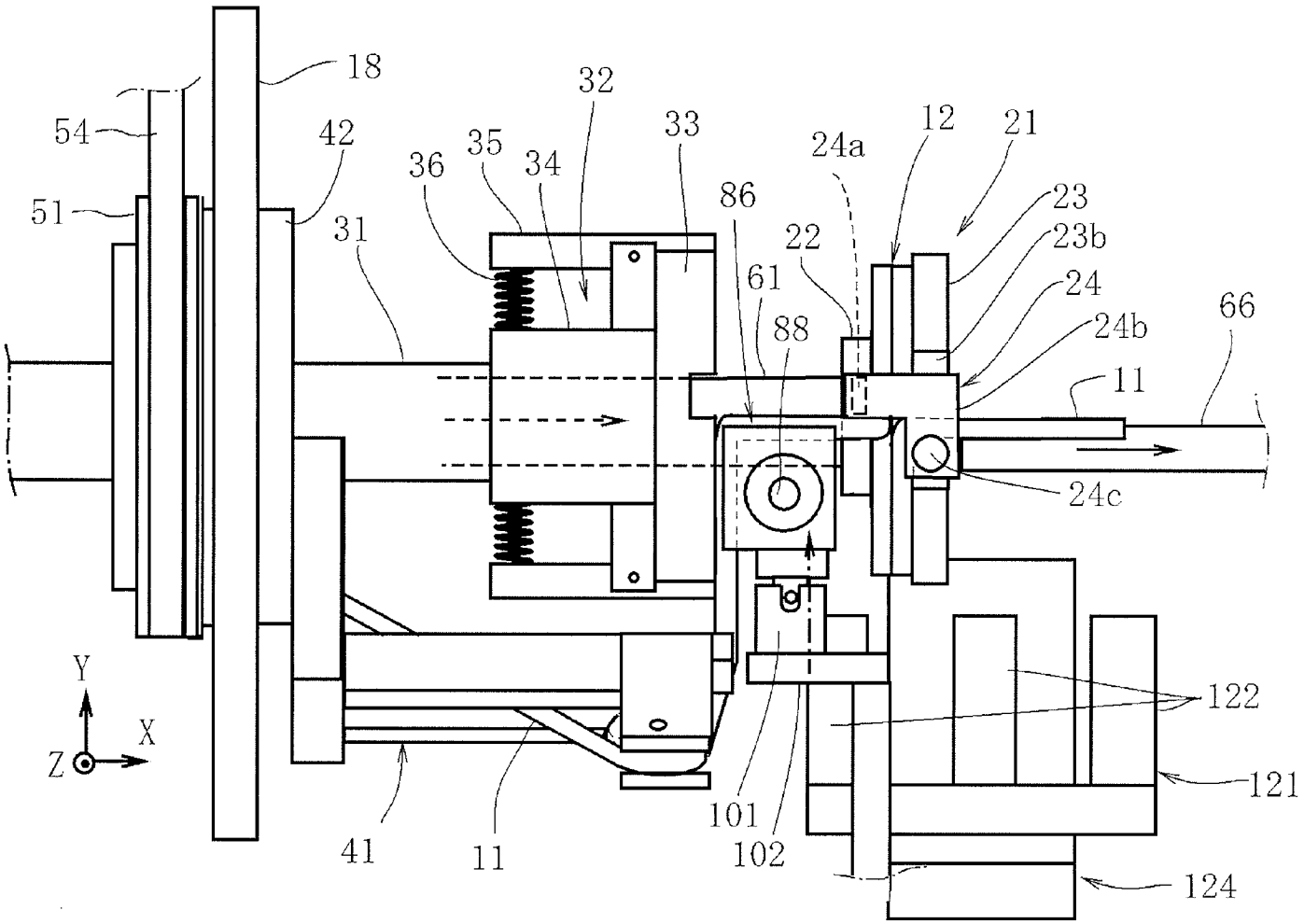
FIG. 20 is a plan view, corresponding to FIG. 13, showing a state where the winding core is pushed out together with the α-winding coil.

As shown in detail in FIG. 20, the plate member 24*b* is formed in L-shape such that a part of the wire rod 11 bent in the X-axis direction with the insertion bar 24*a* as a supporting point and a part of the wire rod 11 bent in the X-axis direction with the pin 24*c* as a supporting point are located on the same line. As shown in FIG. 9, the insertion bar 24*a* is formed to be in contact with one side of the α-winding coil 12 made of the wire rod 11 wound on the core main body 22 in a state where the pin 24*c* is in contact with the outer periphery of the first flange portion 23 and to be slightly longer than the outer diameter D (FIG. 10) of the α-winding coil 12.

As shown in FIG. 5, the second flange portion 33 is formed with a recessed groove 33*b* which avoids the interference of the second flange portion 33 and the pressing member 24 with the winding core 21 mounted on the tip end of the spindle shaft 31. As shown in FIGS. 5 and 7, the first flange portion 23 of the winding core 21 is formed with a flat portion 23*b* to which the pulled-out wire rod 11 of the α-winding coil 12 wound on the winding core 21 is pulled out and with which the pin 24*c* of the pressing member 24 comes into contact. Four tape grooves 22*d* used to wind adhesive tapes around the α-winding coil 12 to prevent the α-winding coil 12 wound on the core main body 22 from losing its shape and parallel to the central axis are formed at every interval of 90° about the center on the outer periphery of the core main body 22 of the winding core 21. Four cutouts 23*a* continuous with the tape grooves 22*d* are radially formed in the first flange portion 23 and the adhesive tapes can be guided to the tape grooves 22*d* via the cutouts 23*a*. Instead of this, the α-winding coil 12 may be fixed by an adhesive to prevent the α-winding coil 12 from losing its shape without using the adhesive tapes.

As shown in FIGS. 1 to 4, the multiple winding apparatus 20 includes a winding core removal mechanism 60 for removing the winding core 21 from the spindle shaft 31 by moving it in the axial direction. The winding core removal mechanism 60 includes the push-out bar 61 which is inserted into the spindle shaft 31 and the tip end of which can come into contact with the winding core 21, and a mover 62 which causes the push-out bar 61 having the winding core 21 held in contact with the tip end thereof to project from the tip end of the spindle shaft 31. The push-out bar 61 is spline-connected to the spindle shaft 31 and inserted into the spindle shaft 31 to be movable in a longitudinal direction of the spindle shaft 31, but not rotatable.

As shown in FIG. 4, a base 63 is provided on the mount 19 on the rear side of the mounting plate 18 and a supporting wall 64 stands on the base 63. The spindle shaft 31 passed through the mounting plate 18 extends in the X-axis direction and the base end thereof is rotatably provided on the supporting wall 64. A servo motor for spindle 37 for rotating the spindle shaft 31 is mounted on the mount 19 near the supporting wall 64. Pulleys 38*a*, 38*b* are respectively provided on the spindle shaft 31 and a rotary shaft 37*a* of the servo motor for spindle 37, and a belt 39 is mounted on these pulleys 38*a*, 38*b*. In this way, when the servo motor for spindle 37 is driven to rotate the rotary shaft 37*a* thereof, that rotation is transmitted to the spindle shaft 31 via the belt 39 and the spindle shaft 31 rotates together with the push-out bar 61.

The entire length of the push-out bar 61 is longer than that of the spindle shaft 31. A holding member 62*a* for holding the push-out bar 61 rotatably, but immovably in the axial direction is provided on a part of the push-out bar 61 projecting from the base end of the spindle shaft 31. The mover 62 for moving the holding member 62*a* in the X-axis direction together with the push-out bar 61 is provided along the spindle shaft 31 on the base 63. The mover 62 includes a housing 62*b* which extends in the X-axis direction and is fixed to the top of the base 63, a ball screw 62*d* which is driven and rotated by a servo motor 62*c* and a follower 62*e* which is threadably engaged with the ball screw 62*d* and moves in parallel. The holding member 62*a* is mounted on the follower 62*e*. In the mover 62, the follower 62*e* is moved by the ball screw 62*d* rotating as the servo motor 62*c* is driven, and the push-out bar 61 moves in the X-axis direction via the holding member 62*a* moving together with the follower 62*e*.

As shown in FIGS. 5 and 6, a bar-like portion 61*a*, for example, in the form of a rectangular column to be inserted into a rectangular hole which is the through hole 22*a* of the winding core 21 while avoiding the insertion bar 24*a* of the pressing member 24 inserted into the insertion hole 22*c* of the winding core 21, and a facing portion 61*b* which is formed adjacent to the bar-like portion 61*a* and faces the insertion bar 24*a* inserted in the insertion hole 22*c* are formed on a tip end part of the push-out bar 61 surrounded by the mounting fixture 32. Thus, the winding core 21 can be mounted on the tip end of the spindle shaft 31 with the push-out bar 61 retracted into the spindle shaft 31 such that the facing portion 61*b* is substantially flush with the bottom surface of the round hole 33*a*. On the other hand, the winding core 21 can be removed from the spindle shaft 31 by causing the push-out bar 61 to project from the tip end of the spindle shaft 31 to bring the facing portion 61*b* into contact with the insertion bar 24*a* and causing the push-out bar 61 to further project in this state. The bar-like portion 61*a* to be inserted into the through hole 22*a* of the winding core 21 while avoiding the insertion bar 24*a* is so configured to be inserted with a small clearance formed between the bar-like portion 61*a* and the inner surface of the through 22*a* and capable of supporting the winding core 21 only on the bar-like portion 61*a*.

As shown in FIGS. 1 to 4, the multiple winding apparatus 20 includes a supporting member 66 which faces the spindle shaft 31 and supports a plurality of winding cores 21 removed by the winding core removal mechanism 60 at desired intervals in the axial direction, and a support member moving mechanism 70 for moving the supporting member 66 in a direction away from the spindle shaft 31. The support member moving mechanism 70 includes a movable table 72 movable in a direction perpendicular to the spindle shaft 31 and a moving plate 76 provided on the movable table 72 and movable in parallel to the spindle shaft 31, and the supporting member 66 is provided on the movable plate 76. Specifically, a pair of conveyor rails 71, 71 extending in the direction perpendicular to the spindle shaft 31, i.e. in the Y-axis direction are provided on the mount 19. The movable table 72 is provided on the pair of conveyor rails 71, 71 movably in a longitudinal direction of the conveyor rails 71, 71. The length of the conveyor rails 71, 71 is at least equal to or longer than the length of the wire rod 11 necessary to wind one coil 12*a* of the α-winding coil 12.

A pair of short rails 73, 73 parallel to the spindle shaft 31 are provided on the movable table 72. A screw shaft 74 is provided rotatably about a central axis between and in parallel to the pair of short rails 73, 73. The moving plate 76 is provided on the pair of short rails 73, 73 movably in a longitudinal direction of the pair of short rails 73, 73, and a screw member 77 threadably engaged with the screw shaft 74 is fixed to the moving plate 76. The screw shaft 74 can be rotated by a servo motor 78. When the servo motor 78 is driven to rotate the screw shaft 74, the screw member 77 threadably engaged with the screw shaft 74 moves together with the moving plate 76 in the longitudinal direction along the pair of short rails 73, 73, i.e. in parallel to the spindle shaft 31. The pair of short rails 73, 73 used to deter mine a moving distance of the moving plate 76 are at least longer than the connecting wire 12*c* (FIG. 10) and the moving plate 76 is movable for a distance equal to or longer than the push-out length of the push-out bar 61.

The supporting member 66 is supported on the moving plate 76 via a mounting member 67. The supporting member 66 faces the spindle shaft 31, is designed to support a plurality of winding cores 21 removed by the winding core removal mechanism 60 at the desired intervals in the axial direction and is formed to have a length capable of supporting the entire multiple-winding core 10 (FIG. 10) desired to be obtained. Thus, in this embodiment designed to obtain the multiple-winding core 10 made up of four α-winding coils 12, the supporting member 66 is fat formed to have a length capable of supporting the multiple-winding core 10 in which at least four α-winding coils 12 are connected by the connecting wires 12*c*. The supporting member 66 is a bar-like member having the same cross-sectional shape as the bar-like portion 61*a* of the push-out bar 61 and insertable into the through hole 22*a* of the core main body 22 excluding a part closed by the pressing member 24. The supporting member 66 is provided in parallel to the spindle shaft 31 such that one end thereof faces the through hole 22*a* of the winding core 21 mounted on the spindle shaft 31 excluding the part closed by the pressing member 24 and the other end thereof is supported in a cantilever manner on the moving plate 76 via the mounting member 67. When the winding core 21 the through hole 22*a* of which is facing the one end of the supporting member 66 is moved in the longitudinal direction by the winding core removal mechanism 60 and removed from the spindle shaft 31, the removed winding core 21 is fitted onto the supporting member 66 and the supporting member 66 supports the removed winding core 21.

An auxiliary plate 81 extending in the Y-axis direction away from the supporting member 66 is fixed to the spindle shaft 31 side of the moving plate 76. A mounting wall 82 stands in the Z-axis direction at a position of the auxiliary plate 81 distant from the supporting member 66, and a movable mechanism in which a projectable shaft 83*a* extends upward in the Z-axis direction, e.g. a fluid pressure cylinder 83 is mounted in the mounting wall 82 (FIG. 3). The base end of an elevating table 84 is mounted on the upper end of the projectable shaft 83*a* of the fluid pressure cylinder 83. In a state where one end of the supporting member 66 is facing the through hole 22*a* of the winding core 21, the tip end of the elevating table 84 is located above the winding core 21. A first lock mechanism 85 including a detachable locking member 86 is provided to face downward on the tip end of the elevating table 84 located above the winding core 21.

Figure 8:
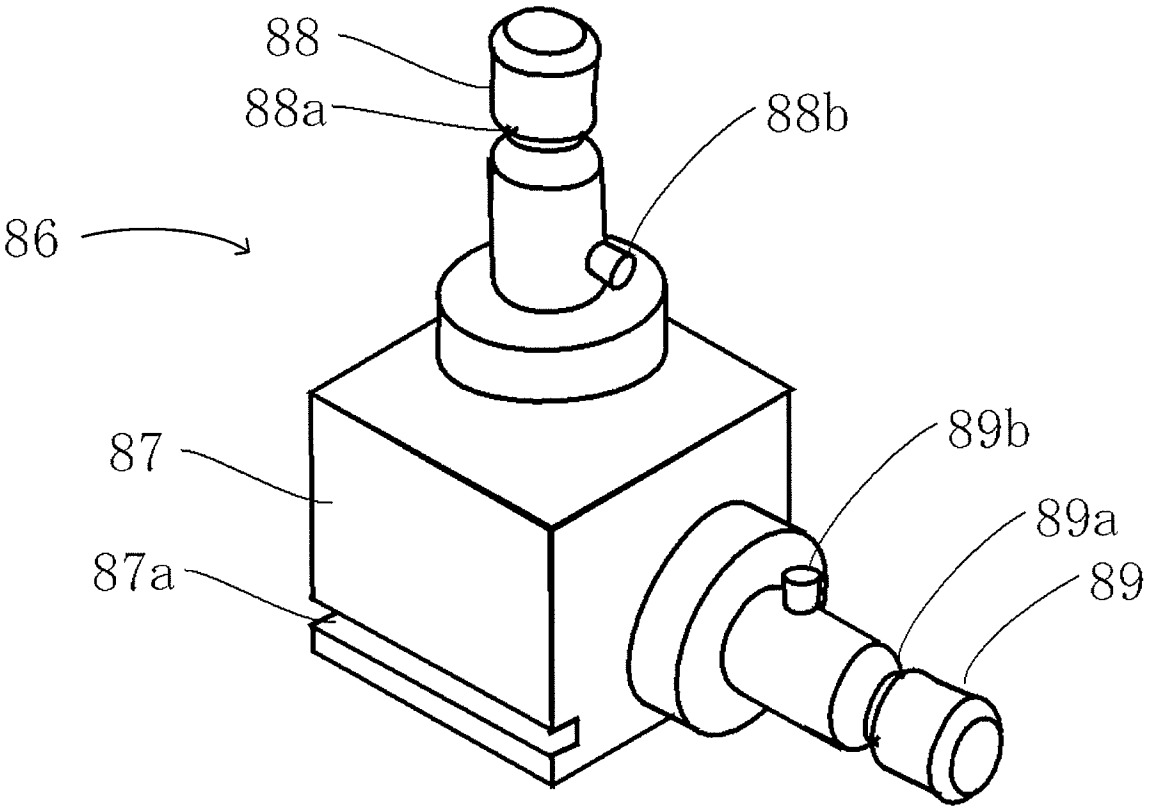
FIG. 8 is a perspective view showing a locking member.

The locking member 86 attached to the elevating table 84 by the first lock mechanism 85 is for holding an end part of the wire rod 11 fed from the wire rod feeding flyer 41. When the winding core 21 is supported on the supporting member 66, the locking member 86 holds the wire rod 11 wound on the winding core 21, extending out from the winding core 21 and connected to the flyer 41 near the winding core 21. Specifically, the locking member 86 holds the wire rod 11 near the winding core 21 as the end part of the wire rod 11 fed from the wire rod feeding flyer 41. As shown in FIG. 8, the locking member 86 includes a block body 87 formed with a locking groove 87*a* for locking the wire rod 11 in a state bent substantially at a right angle, a first coupling shaft 88 for locking the block body 87 to the first lock mechanism 85, and a second coupling shaft 89 provided on the block body 87 to be perpendicular to the first coupling shaft 88.

As shown in FIGS. 3 and 4, the first lock mechanism 85 includes a tubular body 85*a* which is provided below the elevating table 84 and has a coupling hole into which the first coupling shaft 88 is insertable, an unillustrated lock member which is provided on the tubular body 85*a* and engaged with an annular groove 88*a* (FIG. 8) fog fined on the first coupling shaft 88, an operating member 85*b* which is fitted into the tubular body 85*a* and moved in an axial direction to insert or withdraw the unillustrated lock member into or from the annular groove 88*a*, and a spring 85*c* which biases the operating member 85*b* in a direction to insert the lock member into the annular groove 88*a*.

The tubular body 85*a* is formed with a slit 85*d* extending in the axial direction from an end part thereof, and a projection 88*b* insertable into the slit 85*d* is formed on the first coupling shaft 88. Thus, when the first coupling shaft 88 is inserted into the coupling hole of the tubular body 85*a* to attach the block body 87 to the elevating table 84, the projection 88*b* is inserted into the slit 85*d* and the rotation of the block body 87 relative to the elevating table 84 is prohibited. In this way, with the locking member 86 attached to the elevating table 84, the rotation of the locking member 86 is prohibited and a situation where the wire rod 11 locked in the locking groove 87*a* of the block body 87 comes out of the locking groove 87*a* can be prevented.

An operating mechanism for operating the first lock mechanism 85, e.g. an operating cylinder 91 is further provided on the elevating table 84. The operating member 85*b* of the first lock mechanism 85 is attached to a rod 91*a* of the operating cylinder 91. When the operating cylinder 91 causes the rod 91*a* to retract as shown by a solid line arrow, the operating member 85*b* moves backward against a biasing force of the spring 85*c* and the first coupling shaft 88 can be inserted into the coupling hole on the tubular body 85*a*. When the rod 91*a* is caused to project as shown by a broken line arrow with the first coupling shaft 88 inserted in the coupling hole, the operating member 85*b* moves forward again and the unillustrated lock member is pressed against the annular groove 88*a*. In this way, the first coupling shaft 88 does not come out from the tubular body 85*a* including the coupling hole.

On the other hand, when the operating cylinder 91 causes the rod 91*a* thereof to retract again as shown by the solid line arrow with the first coupling shaft 88 inserted in the tubular body 85*a*, the already inserted first coupling shaft 88 can come out of the tubular body 85*a*. The locking member 86 is configured to be attachable to and detachable from the elevating table 84 by such a first lock mechanism 85.

To move the moving plate 76, on which the elevating table 84 and the supporting member 66 are provided, together with the movable table 72 in the direction substantially perpendicular to the spindle shaft 31, a rack gear 92 is provided on a side surface of the mount 19 along the conveyor rails 71. A servo motor for conveyance 94 with a rotary shaft 94*a* on which a pinion gear 93 engaged with the rack gear 92 is provided is fixed to the movable table 72. Thus, when the servo motor for conveyance 94 is driven to rotate the rotary shaft 94*a* thereof in response to a command from an unillustrated controller, the pinion gear 93 rolls on the rack gear 92 and the servo motor for conveyance 94 moves along the rack gear 92 together with the movable table 72. In this way, the movable table 72 is movable in a direction away from or toward the spindle shaft 31. In the case of bringing the movable table 72 closer to the spindle shaft 31, the tip end of the supporting member 66 can be caused to face the through hole 22*a* not closed by the pressing member 24 of the winding core 21.

Figure 1:
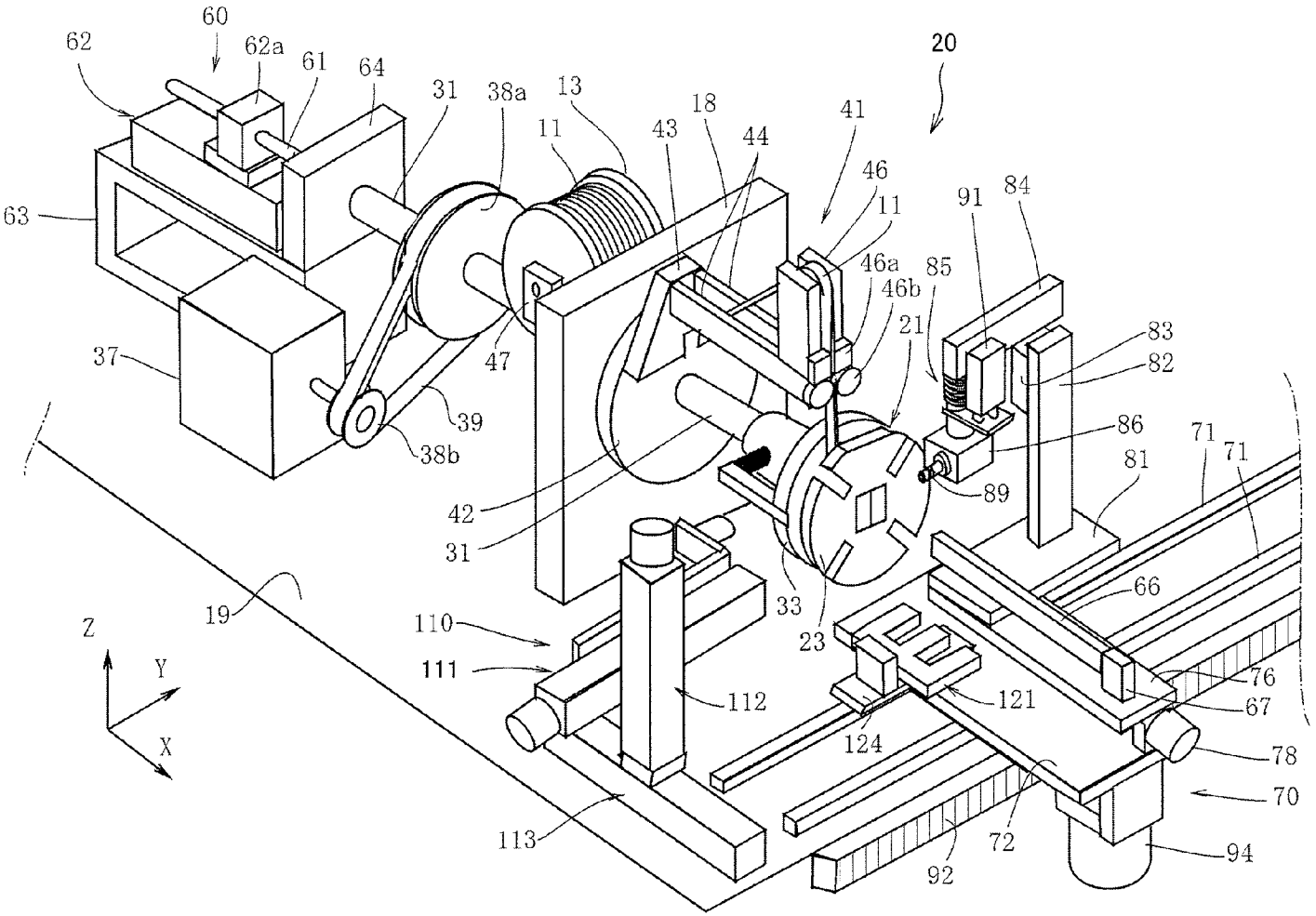
FIG. 1 is a perspective view showing a multiple winding apparatus according to an embodiment of the present invention.
Figure 2:
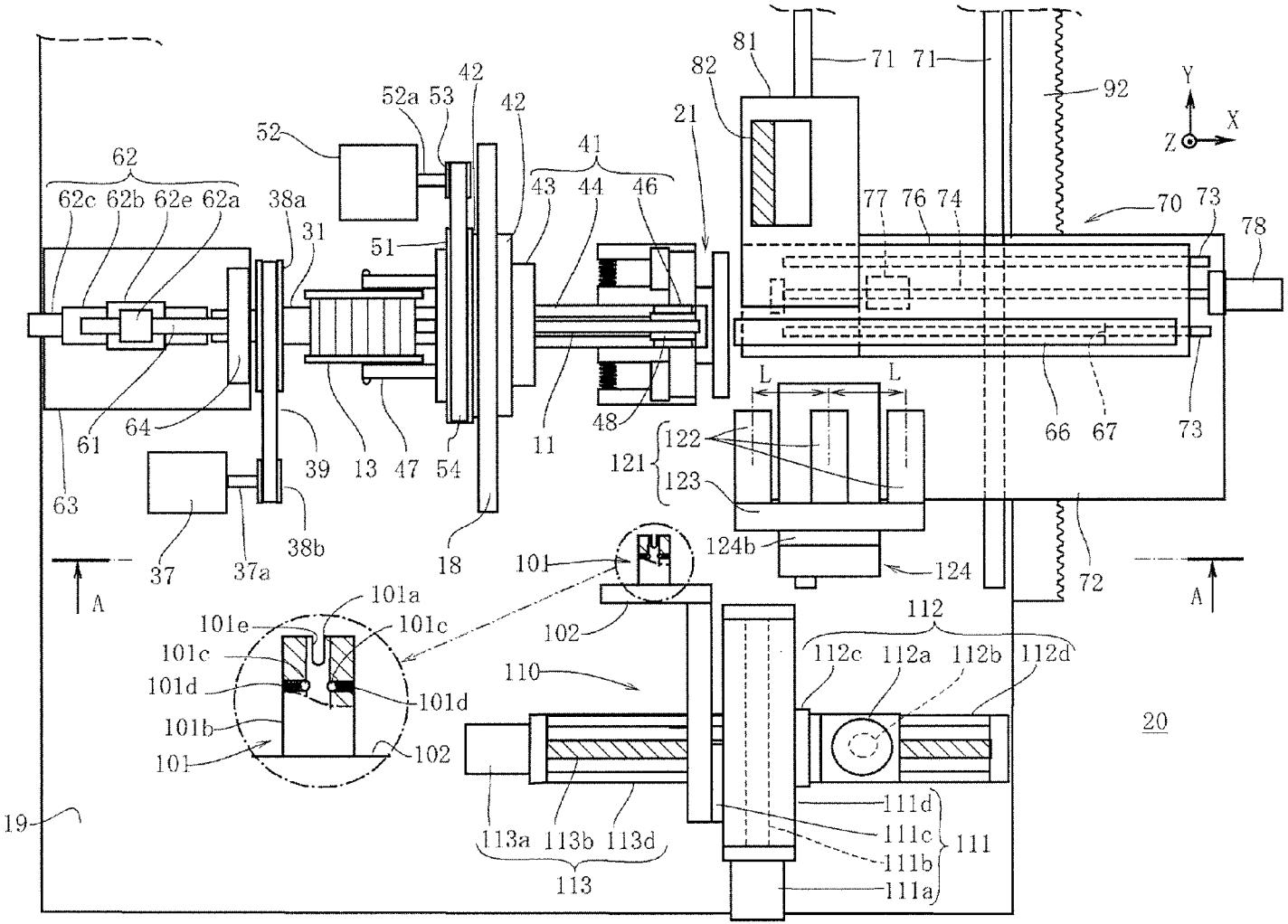
FIG. 2 is a plan view showing the multiple winding apparatus.

As shown in FIGS. 2 and 3, a second lock mechanism 101 for inseparably holding the locking member 86 in a state where the tip end of the supporting member 66 is facing the through hole 22*a* not closed by the pressing member 24 of the winding core 21 is provided on the mount 19 via a moving mechanism 110. The second lock mechanism 101 includes a tubular body 101*b* with a coupling hole 101*a* into which the second coupling shaft 89 of the locking member 86 is insertable, a lock member 101*c* provided on the tubular body 101*b* and engaged with an annular groove 89*a* (FIG. 8) formed on the second coupling shaft 89, and a spring 101*d* or an O-ring (spring is used in the shown example) for pressing the lock member 101*c* against the annular groove 89*a*.

The tubular body 101*b* is formed with a slit 101*e* extending in an axial direction from an end part thereof, and a projection 89*b* insertable into the slit 101*e* is formed on the second coupling shaft 89. Thus, when the second coupling shaft 89 is inserted into the coupling hole against a biasing force of the spring 101*d* or the O-ring, the lock member 101*c* is pressed against the annular groove 89*a* (FIG. 8) by the biasing force of the spring 101*d* or the O-ring, whereby the second coupling shaft 89 does not come out from the coupling hole 101*a*. Since the projection 89*b* is inserted into the slit 101*e* with the second coupling shaft 89 inserted in the coupling hole 101*a*, the locking member 86 is unrotatably attached to the second lock mechanism 101.

The moving mechanism 110 is so configured that the second lock mechanism 101 is movable in three axial directions relative to the mount 19. The moving mechanism 110 is configured by a combination of X-axis, Y-axis and Z-axis direction expanding actuators 111 to 113. Each expanding actuator 111 to 113 includes a long and narrow box-shaped housing 111*d* to 113*d*, a ball screw 111*b* to 113*b* extending in a longitudinal direction in the housing 111*d* to 113*d* and driven and rotated by a servo motor 111*a* to 113*a*, and a follower 111*c* to 113*c* threadably engaged with the ball screw 111*b* to 113*b* to move in parallel. When the servo motor 111*a* to 113*a* is driven to rotate the ball screw 111*b* to 113*b*, the follower 111*c* to 113*c* threadably engaged with the ball screw 111*b* to 113*b* moves along the longitudinal direction of the housing 111*d* to 113*d*.

A supporting plate 102 on which the second lock mechanism 101 is provided is attached to the follower 111*c* of the Y-axis direction expanding actuator 111 so as to be movable in the Y-axis direction. The housing 111*d* of the Y-axis direction expanding actuator 111 is attached to the follower 112*c* of the Z-axis direction expanding actuator 112 so that the supporting plate 102 is movable in the Z-axis direction together with the Y-axis direction expanding actuator 111. The housing 112*d* of the Z-axis direction expanding actuator 112 is attached to the follower 113*c* of the X-axis direction expanding actuator 113 so that the supporting plate 102 is movable in the X-axis direction together with the Y-axis and Z-axis direction expanding actuators 112, 111. The housing 113*d* of the X-axis direction expanding actuator 113 extends in the X-axis direction and is fixed to the mount 19. The respective servo motors 111*a* to 113*a* of the respective expanding actuators 111 to 113 are connected to the unillustrated controller and controlled by output signals from the controller.

As shown in FIGS. 2 and 3, a comb member 121 for restricting movements of a plurality of winding cores 21 supported at the desired intervals in the axial direction on the supporting member 66 is provided on the movable table 72. The comb member 121 includes a plurality of inserting members 122 insertable between the plurality of winding cores 21 supported at the desired intervals, and a base plate 123 supporting the plurality of inserting members 122 at each of the desired intervals between the plurality of winding cores 21. The desired intervals between the plurality of inserting members 122 are the same as a length L of the connecting wires 12*c* between the α-winding coils 12 in the multiple-winding coil 10 (FIG. 10) desired to be obtained. The plurality of inserting members 122 are insertable between the plurality of winding cores 21 in a state where a plurality of α-winding coils 12 connected by the connecting wires 12*c* are respectively wound on the winding cores 21.

The length L of each connecting wire 12*c* between the α-winding coils 12 shown in FIG. 10 can be changed. For example, the length L of the connecting wire 12*c* between the α-winding coil 12 first obtained by winding the wire rod 11 and the second α-winding coil 12 obtained next and the length L of the connecting wire 12*c* between the second α-winding coil 12 and the third α-winding coil 12 obtained next can be made different. In this case, the lengths L of the connecting wires 12*c* can be changed by correspondingly changing the length L between the first inserting member 122 and the second inserting member 122 located next and the length L between the second inserting member 122 and the third inserting member 122 located next shown in FIG. 2 according to the respective lengths of the connecting wires 12*c* sought to be different.

The comb member 121 is attached to the movable table 72 via a movable mechanism capable of reciprocating the comb member 121 in the Y-axis direction, e.g. a fluid pressure cylinder 124. The fluid pressure cylinder 124 is fixed to a slider 124*a*, which is moved by a fluid pressure, via a mounting piece 124*b*. The fluid pressure cylinder 124 is configured to reciprocate the comb member 121 between a first position where the plurality of inserting members 122 are inserted between the plurality of winding cores 21 to prevent movements of these plurality of winding cores 21 in the axial direction and a second position where the plurality of inserting members 122 come out from clearances between the plurality of winding cores 21 to permit movements of these plurality of winding cores 21 in the axial direction.

Although not shown, a hot air generator, an adhesive applicator or the like for heating and melting the wire rod 11 taken up on the winding core 21 is also provided on the mount 19.

Next, a multiple winding method for coil using the multiple winding apparatus 20 is described.

The multiple winding method for coil premises to include the spindle shaft 31 on which the winding core 21 is removably mounted and which rotates together with the winding core 21, and the wire rod feeding flyer 41 which feeds the wire rod 11 while rotating around the winding core 21 mounted on the spindle shaft 31. The method includes a first pull-out step of holding and pulling out the wire rod 11 fed from the wire rod feeding flyer 41*a* predetermined distance, a winding step of winding the pulled-out wire rod 11 on the winding core 21 by rotating the winding core 21, an α-winding coil forming step of forming the α-winding coil 12 by rotating the wire rod feeding flyer 41 in the same direction as the winding core 21 to wind the wire rod 11 fed from the wire rod feeding flyer 41 on the winding core 21, a removing step of removing the α-winding coil 12 together with the winding core 21 from the spindle shaft 31 and a second pull-out step of moving the removed winding core 21 together with the α-winding coil 12 and pulling out the wire rod 11*a* predetermined length from the wire rod feeding flyer 41 anew. Thereafter, the steps from the winding step to the second pull-out step are repeated to form a desired number of α-winding coils 12 connected to each other. Each step is described in detail below.

<First Pull-Out Step>

Figure 11:
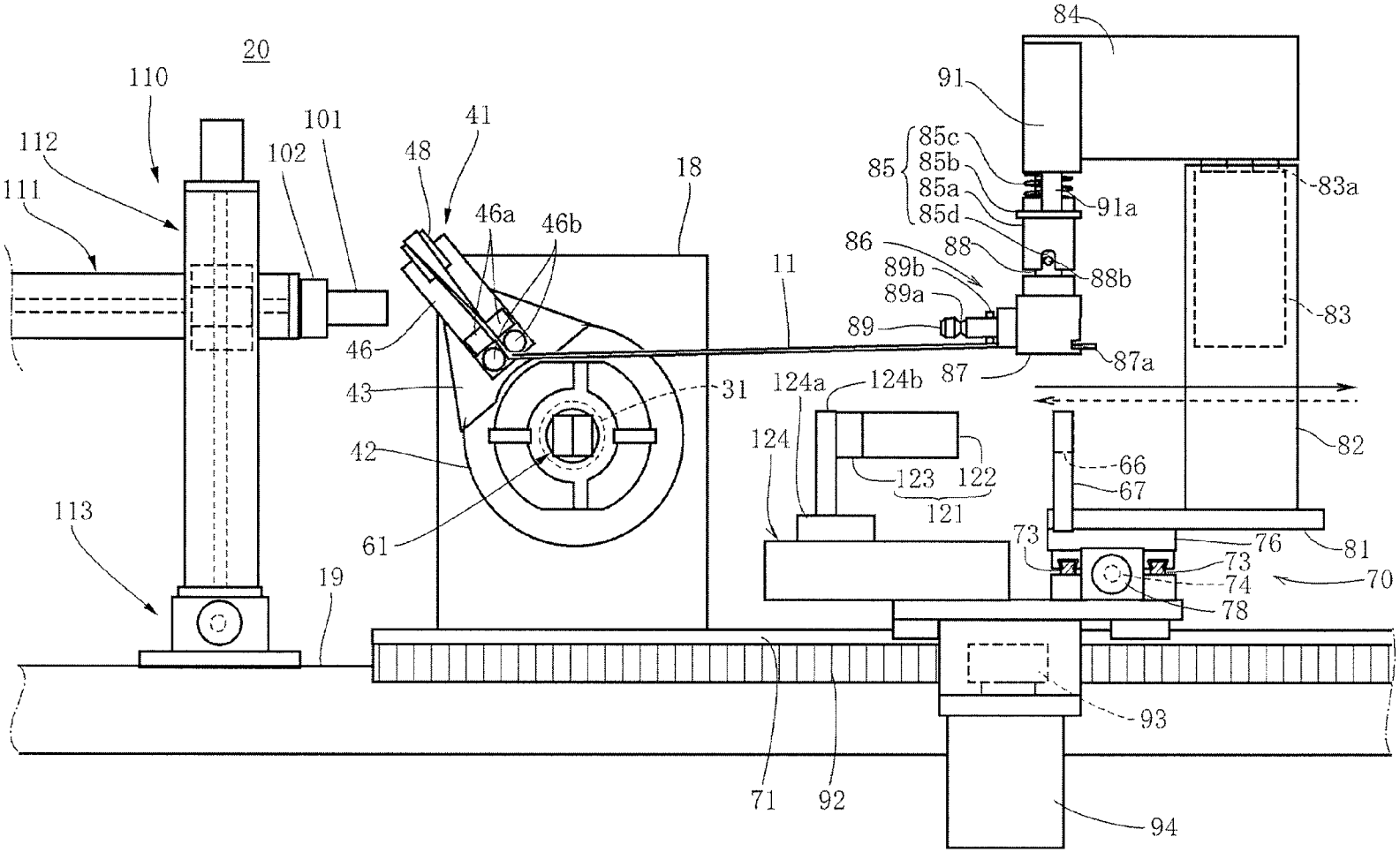
FIG. 11 is a front view of the multiple winding apparatus showing a state where the wire rod fed from a wire rod feeding flyer is held and pulled out.

In this step, the wire rod 11 fed from the wire rod feeding flyer 41 is held and pulled out the predetermined length. The wire rod 11 wound on the wire storage drum 13 is rotatably supported together with the wire storage drum 13 in the rotary supporting member 47 behind the circular plate 42. After being passed through the unillustrated communication hole of the circuit plate 42, the wire rod 11 fed from the wire storage drum 13 is turned by the second turning pulley 49 and the first turning pulley 48. Then, as shown in FIG. 11, the locking member 86 is attached to the elevating table 84 by the first lock mechanism 85 and an end part of the wire rod 11 having passed the sandwiching pieces 46*a* and the pulley 46*b* is locked in the locking groove 87*a* of the locking member 86. At this time, to relatively smoothly pull out the wire rod 11, it is preferable that the flyer 41 is inclined by about 45° or more in a direction away from the locking member 86 with respect to the Z-axis direction by slightly rotating the circular plate 42 as shown in FIG. 11.

The wire rod 11 is pulled out by moving the movable table 72 together with the locking member 86 having the end part of the wire rod 11 locked therein in a direction away from the flyer 41 as shown by a solid line arrow of FIG. 11. The movable table 72 is moved by driving the servo motor for conveyance 94 to rotate the rotary shaft 94*a* thereof and causing the pinion gear 93 to roll on the rack gear 92. The movement of the movable table 72 is stopped when the length of the pulled-up wire rod 11 becomes substantially equal to a length necessary to wind one coil 12*a* of the α-winding coil 12, whereby the first pull-out step is finished.

<Winding Step and α-Winding Coil Forming Step>

In this embodiment, a case is shown where the winding step and the α-winding coil forming step are simultaneously performed. In these steps, the winding core 21 is mounted on the tip end of the spindle shaft 31, the spindle shaft 31 is rotated to rotate the winding core 21, thereby winding the pulled-out wire rod 11 on the winding core 21, and the wire rod feeding flyer 41 is rotated in the same direction at a rotation speed twice as fast as the rotation of the wire rod 21 to wind the wire rod 11 fed from the wire rod feeding flyer 41 on the winding core, whereby the α-winding coil 12 is foamed. The winding step is first started by mounting the winding core 21 on the tip end of the spindle shaft 31. The winding core 21 is mounted by inserting one end of the core main body 22 into the round hole 33*a* on the tip end of the spindle shaft 31 and bringing the tip end surface of the core main body 22 into contact with the bottom surface of the round hole 33*a* (FIG. 6). In this way, the locking claws 35*a* are locked in the locking holes 22*b* on the winding core 21 and the winding core 21 is mounted on the tip end of the spindle shaft 31. When the winding core 21 is mounted, the spacing between the first and second flange portions 23, 33 is set to be slightly larger than the winding width H (FIG. 10) of the α-winding coil 12 desired to be obtained. Thereafter, winding is performed.

Figure 12:
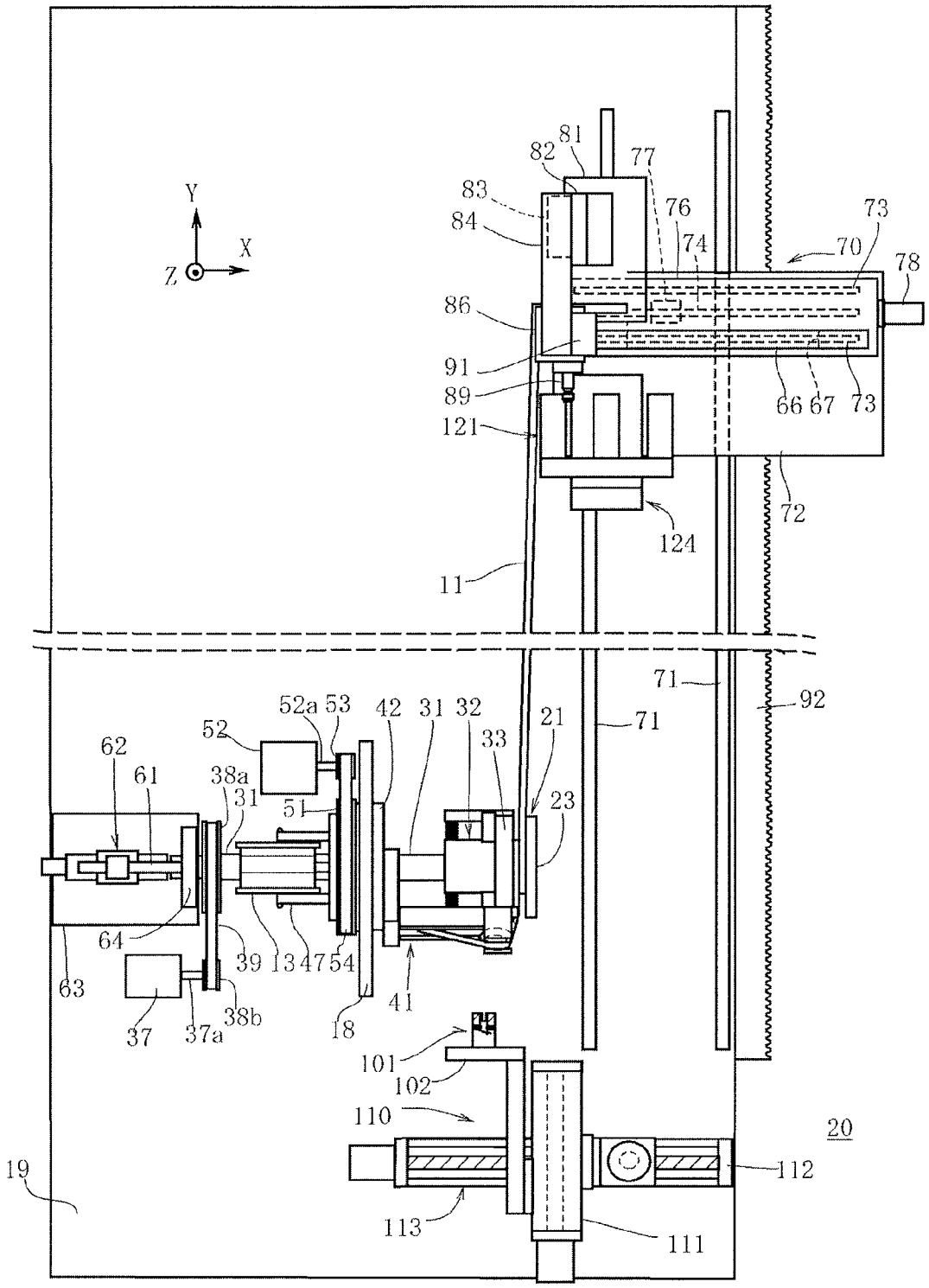
FIG. 12 is a plan view of the multiple winding apparatus showing a state where the pull-out of the wire rod is completed.

In winding, the flyer 41 is first rotated one turn around the winding core 21 and then the wire rod 11 fed therefrom is wound one turn on the core main body 22 of the winding core 21. As shown in FIG. 12, the wire rod 11 wound one turn on the winding core 21 is displaced in a width direction while being wound one turn on the core main body 22, the wire rod 11 fed from the flyer 41 is displaced toward the second flange portion 33 and the wire rod 11 pulled out in advance in the pull-out step is displaced toward the first flange portion 23. The first wire rod 11 wound one turn on this core main body 22 becomes the inner connecting wire 12*d* of the α-winding coil 12 (FIG. 10).

In this state, the spindle shaft 31 is subsequently rotated together with the winding core 21 and the flyer 41 is rotated in the same direction at the speed twice as fast as the rotation of the spindle shaft 31. When the winding core 21 is rotated, for example, in a counterclockwise direction of FIG. 11, the wire rod 11 pulled out in advance is taken up on the winding core 21 and spirally wound along the first flange portion 23. At this time, the movement of the movable table 72 by the servo motor for conveyance 94 is controlled to apply a certain tension necessary for winding to the wire rod 11, and the locking member 86 is brought closer to the winding core 21 as shown by a broken line arrow of FIG. 11 together with the movable table 72. In this case, as shown in FIG. 12, the moving plate 76 is moved in the X-axis direction away from the spindle shaft 31 and the pulled-out wire rod 11 is inclined in a direction away from the spindle shaft 31 with an increasing distance from the winding core 21 while extending along a line perpendicular to a center of rotation of the winding core 21. In this way, the pulled-out wire rod 11 is wound on the winding core 21 while being displaced toward the first flange portion 23, whereby the α-winding coil 12 can be more accurately formed.

Figure 13:
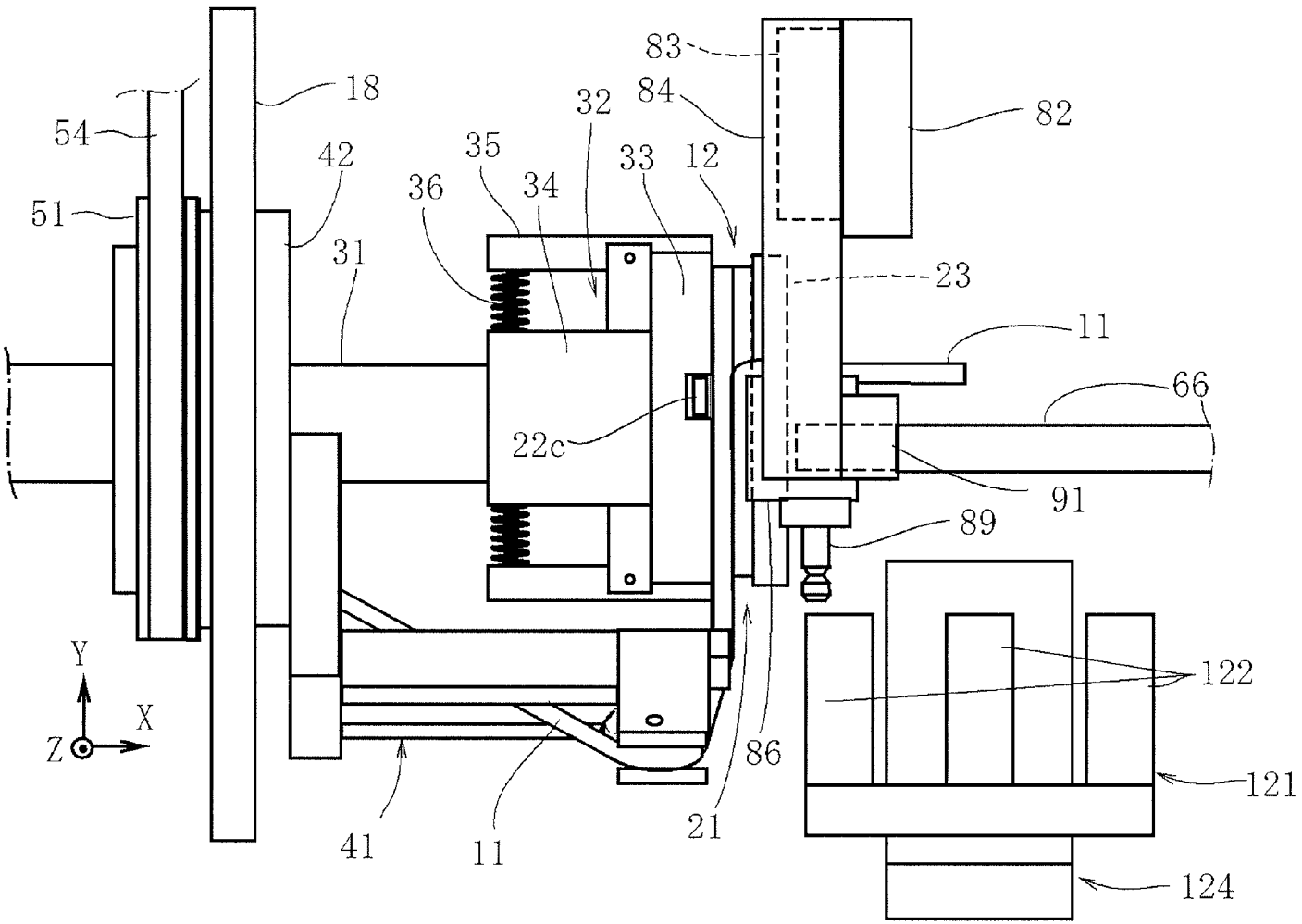
FIG. 13 is an enlarged plan view showing a state where the α-winding coil is obtained by winding the wire rod on the winding core.

Simultaneously, the flyer 41 rotates around the winding core 21 in the same direction as the rotation direction of the winding core 21 at the speed twice as fast. This causes the wire rod 11 fed from the flyer 41 to be simultaneously wound on the winding core 21. In this case, the wire rod 11 is fed along the second flange portion 33 from the flyer 41 and wound on the core main body 22 while being displaced toward the second flange portion 33. This winding step is finished when the pulled-out wire rod 11 is entirely wound on the winding core 21 and the supporting member 66 faces the winding core 21 as shown in FIG. 13. In this way, the α-winding coil 12 is formed in which the end of the pulled-out wire rod 11 wound by the rotation of the winding core 21 and the end of the wire rod 11 fed from the flyer 41 and wound on the winding core 21 are both located on the outermost periphery.

<Removing Step>

In this step, the α-winding coil 12 formed by winding the wire rod 11 on the winding core 21 is removed from the spindle shaft 31 together with the winding core 21 and the winding core 21 is supported on the supporting member 66 provided to face the spindle shaft 31. In this removing operation, the locking member 86 attached to the elevating table 84 via the first lock mechanism 85 (FIG. 4) is transferred to the second lock mechanism 101 in advance as shown in FIG. 14.

Figure 15:
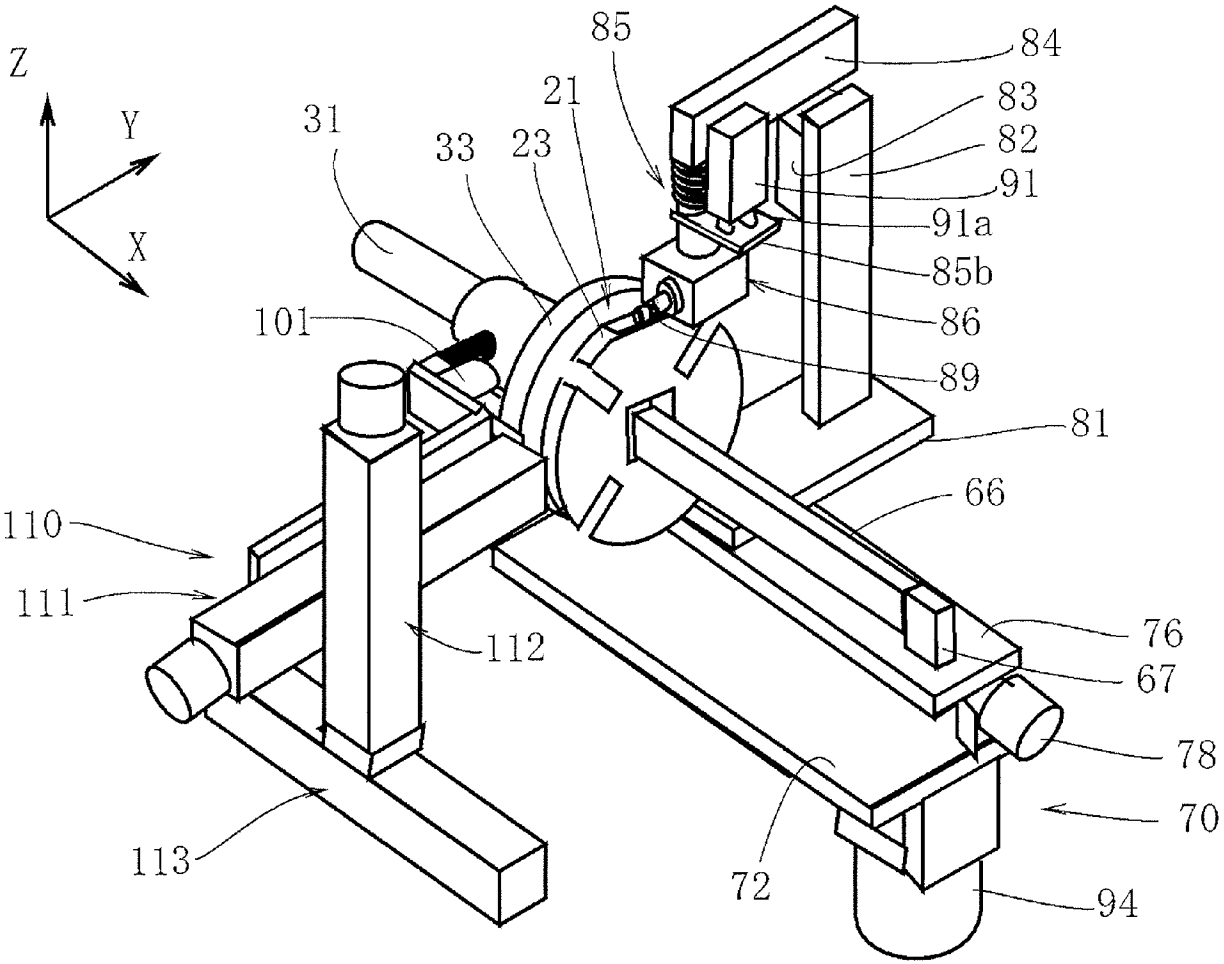
FIG. 15 is a perspective view showing a state where the wire rod is wound on the winding core, a supporting member is facing the winding core and the locking member is located above the winding core.
Figure 16:
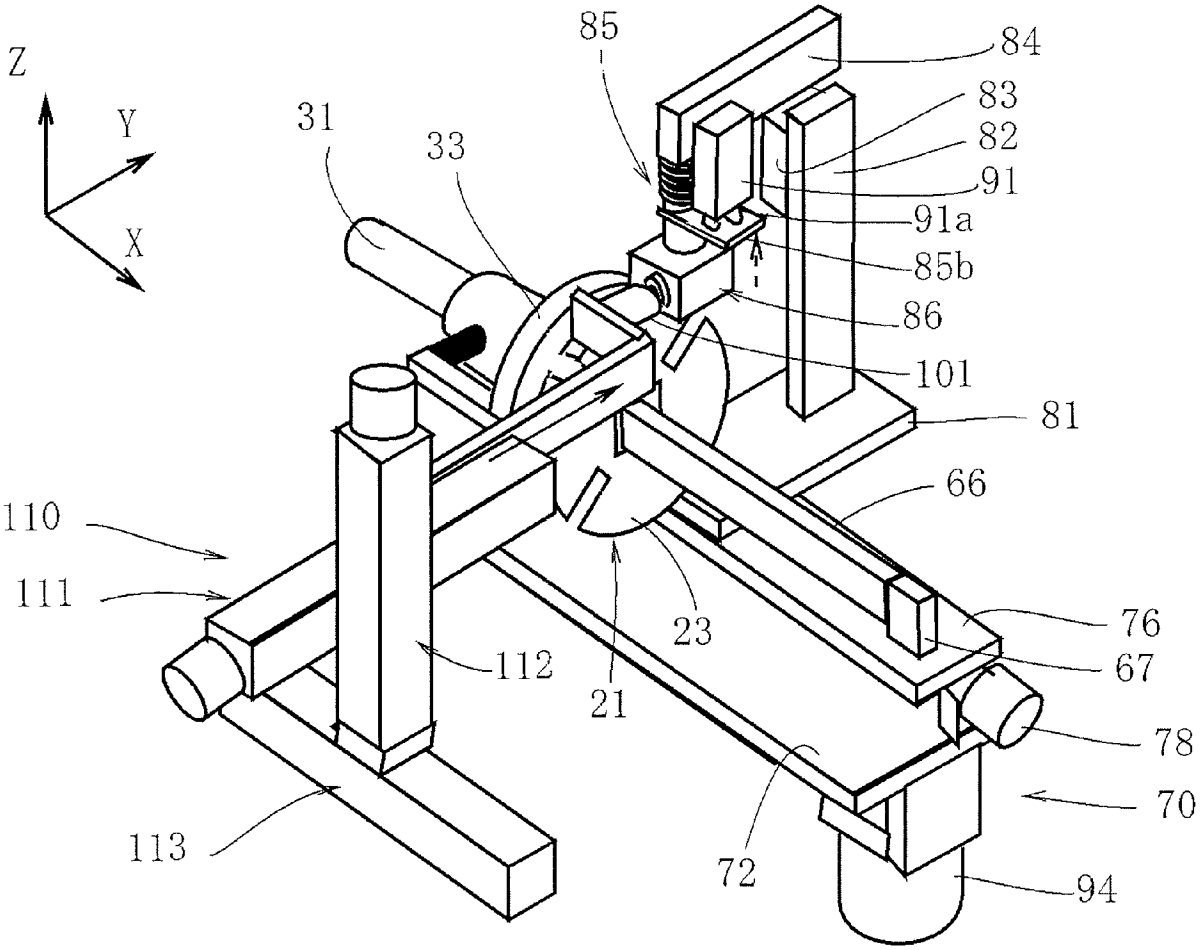
FIG. 16 is a perspective view, corresponding to FIG. 15, showing a state where a second lock mechanism is moved to attach the locking member to the second lock mechanism.
Figure 17:
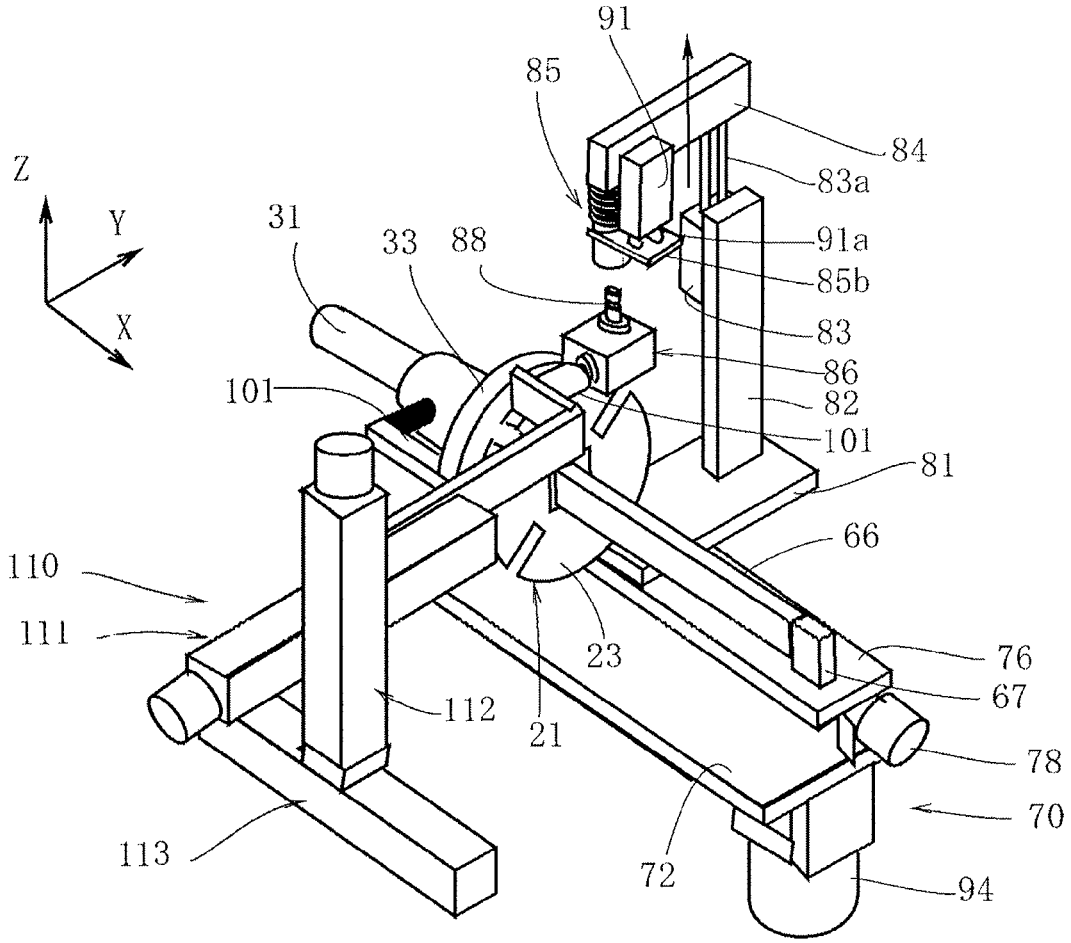
FIG. 17 is a perspective view, corresponding to FIG. 15, showing a state where an elevating table is raised to detach the locking member from a first lock mechanism.

The transfer of the locking member 86 is specifically described. As shown in FIG. 15, when the winding step is finished and the supporting member 66 faces the winding core 21, the locking member 86 in which the end part of the wire rod 11 is locked is located above the winding core 21. Thus, as shown in FIG. 16, the second lock mechanism 101 is first moved by the moving mechanism 110 as shown by a solid line arrow and the second coupling shaft 89 on the locking member 86 is inserted into the coupling hole 101*a* (FIG. 2) to attach the locking member 86 to the second lock mechanism 101. Thereafter, the rod 91*a* of the operating cylinder 91 is caused to retract as shown by a broken-line arrow, thereby moving the operating member 85*b* backward and releasing the first lock mechanism 85. In this state, as shown in FIG. 17, the elevating table 84 is moved upward by causing the projectable shaft 83*a* of the fluid pressure cylinder 83 to project. In this way, the locking member 86 is detached from the first lock mechanism 85 and fixed to the second lock mechanism 101. In this way, the transfer of the locking member 86 is completed.

Figure 14:
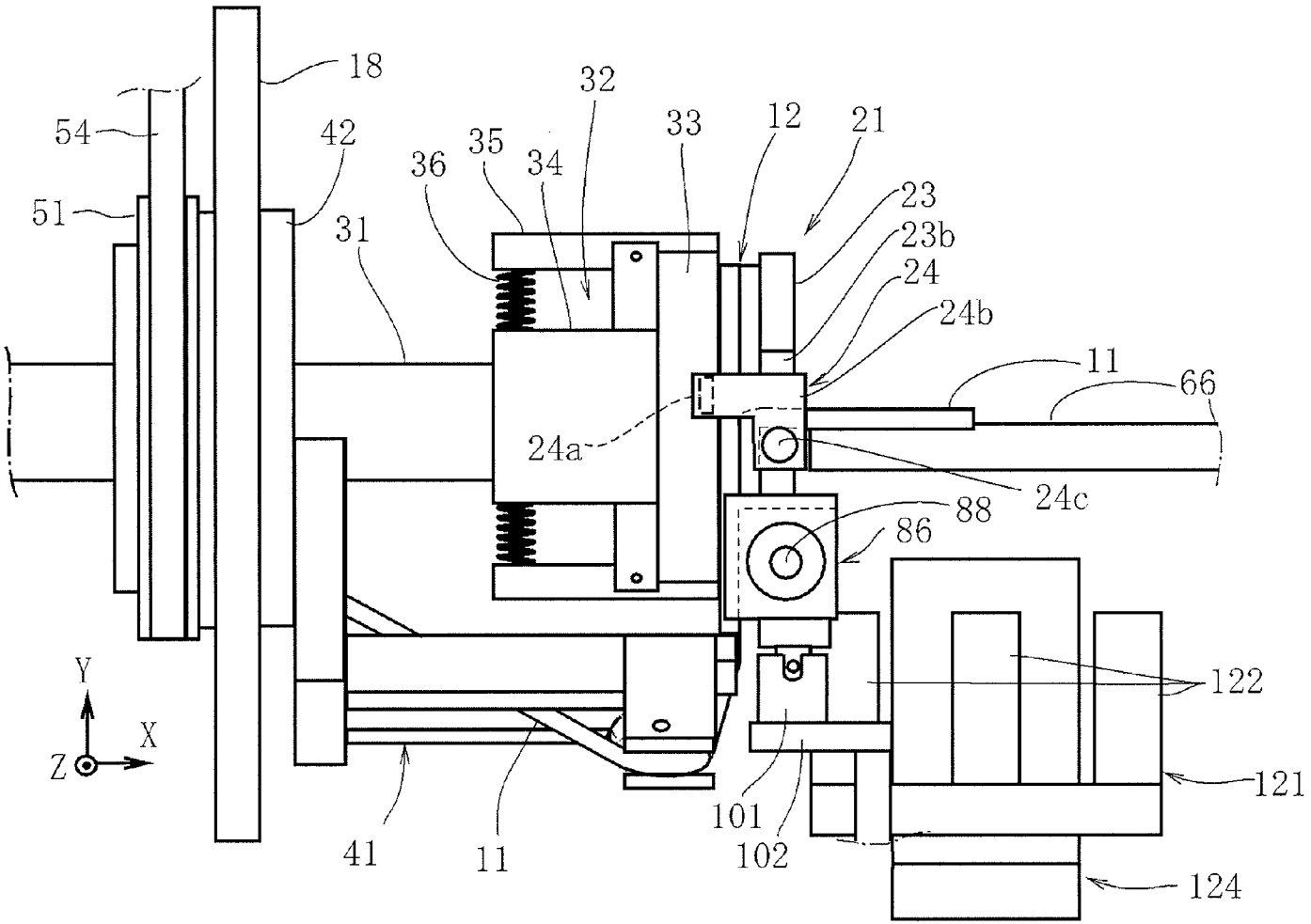
FIG. 14 is a plan view, corresponding to FIG. 13, showing a state where the collapse of the α-winding coil is prevented by the pressing member.
Figure 18:
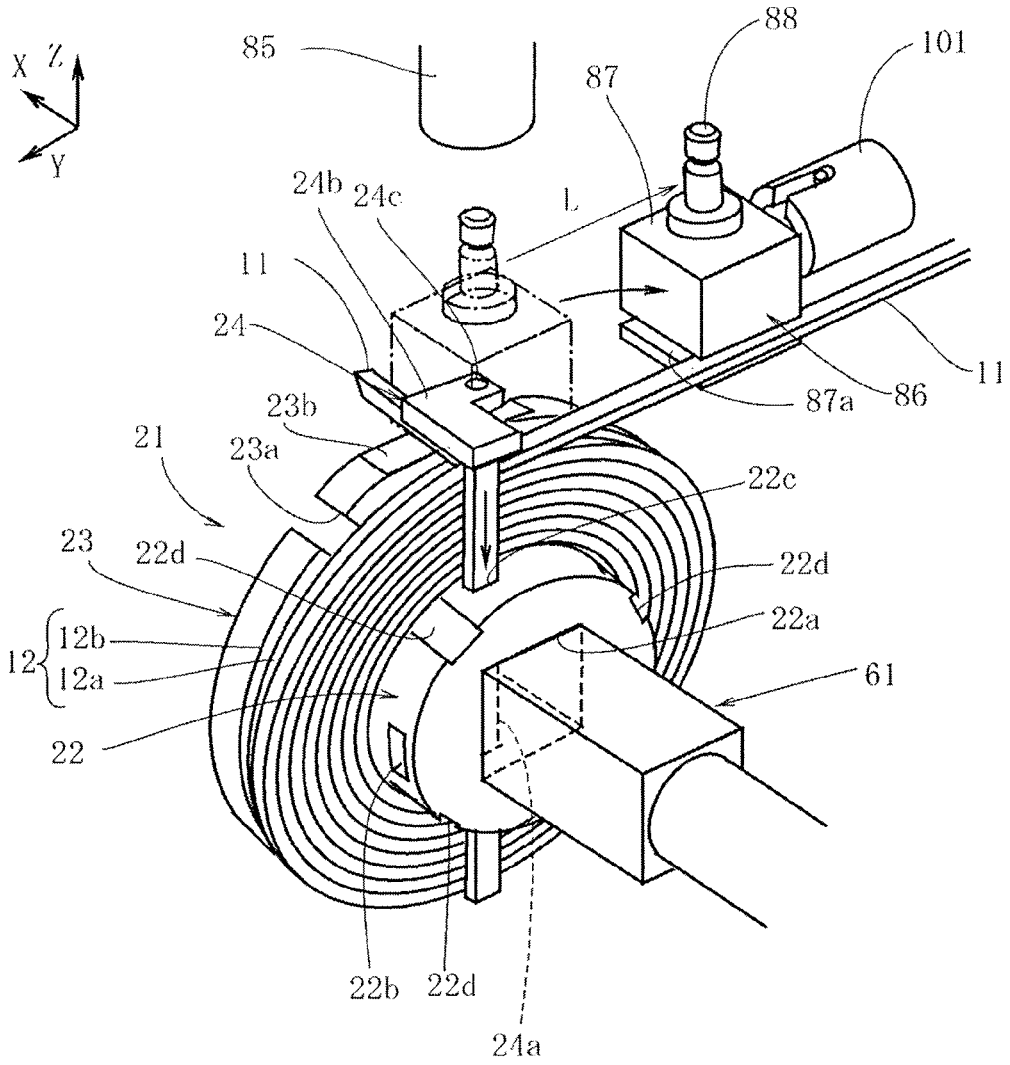
FIG. 18 is a perspective view showing a state where the locking member is moved toward the flyer and placed along the wire rod fed from the flyer.

Thereafter, as shown in FIGS. 14 and 18, the moving mechanism 110 moves the locking member 86 toward the flyer 41 and locates the locking member 86 along the wire rod 11 fed from the flyer 41. At this time, a moving distance of the locking member 86 is set at a distance substantially equal to the amount of pushing-out of the winding core 21 performed by the push-out bar 61 thereafter, i.e. the length L (FIG. 10) of the connecting wire 12*c* between the α-winding coils 12 to be described later and the locking member 86 is accommodated in the locking groove 87*a* (FIG. 3) along the wire rod 11.

Since a side above the winding core is open if the locking member 86 is moved in this way, the pressing member 24 is inserted into the insertion hole 22*c* formed in the core main body 22 via an open space above the winding core 21. Then, as shown in FIGS. 14 and 18, the pin 24*c* is brought into contact with the outer periphery of the first flange portion 23 and the start end of the wire rod 11 to be wound, which is bent from the obtained α-winding coil 12 extending in the circumferential direction and crosses across the flat portion 23*b* of the first flange portion 23, is pressed by the plate member 24*b*. Simultaneously, the pin 24*c* is located on the inner side of the bend of the wire rod 11 to prevent the start end of the wire rod 11 from becoming loose. Then, the insertion bar 24*a* inserted into the insertion hole 22*c* is brought into contact with one side of the α-winding coil 12 wound on the core main body 22 to prevent the α-winding coil 12 from being displaced in the width direction and becoming loose, whereby a situation where the obtained α-winding coil 12 loses its shape can be prevented by the pressing member 24.

Subsequently, the winding core 21 on which the obtained α-winding coil 12 is wound is removed. This removal is performed by the winding core removal mechanism 60 in the state where the locking claws 35*a* are brought out of the locking holes 22*b* on the core main body 22. Specifically, the tip ends of the pair of levers 35 are moved away from each other against the biasing forces of the coil springs 36 by an unillustrated operating device to bring the locking claws 35*a* out of the locking holes 22*b* of the core main body 22. In this state, the push-out bar 61 is caused to project from the tip end of the spindle shaft 31 as shown by a broken line arrow of FIG. 20 by the mover 62 (FIG. 2). Then, the facing portion 61*b* (FIG. 6) of the push-out bar 61 projecting from the tip end of the spindle shaft 31 is brought into contact with the insertion bar 24*a* and the push-out bar 61 is caused to further project in this state, whereby the winding core 21 is removed from the spindle shaft 31. At this time, the bar-like portion 61*a* (FIG. 6) is inserted into the through hole 22*a* of the winding core 21 while avoiding the insertion bar 24*a* with a small clearance between the inner surface of the through hole 22*a* and the bar-like portion 61*a* and the winding core 21 is supported only by the bar-like portion 61*a*. A moving amount of the winding core 21 in the X-axis direction is set to be substantially equal to the length L of the connecting wire 12*c* (FIG. 10) between the α-winding coils 12.

When being pushed out, the push-out bar 61 comes into contact with the supporting member 66 facing the push-out bar 61. However, to avoid this, the supporting member 66 the tip end of which is facing the bar-like portion 61*a* of the push-out bar 61 is moved in the same direction as the moving direction of the push-out bar 61 as shown by a solid-like arrow of FIG. 20 simultaneously as the push-out bar 61 projects. As shown in FIG. 4, by driving the servo motor 78 to rotate the screw shaft 74, the supporting member 66 is moved in parallel to the spindle shaft 31 in the direction away from the spindle shaft 31 together with the moving plate 76 threadably engaged with the screw shaft 74.

Figure 19:
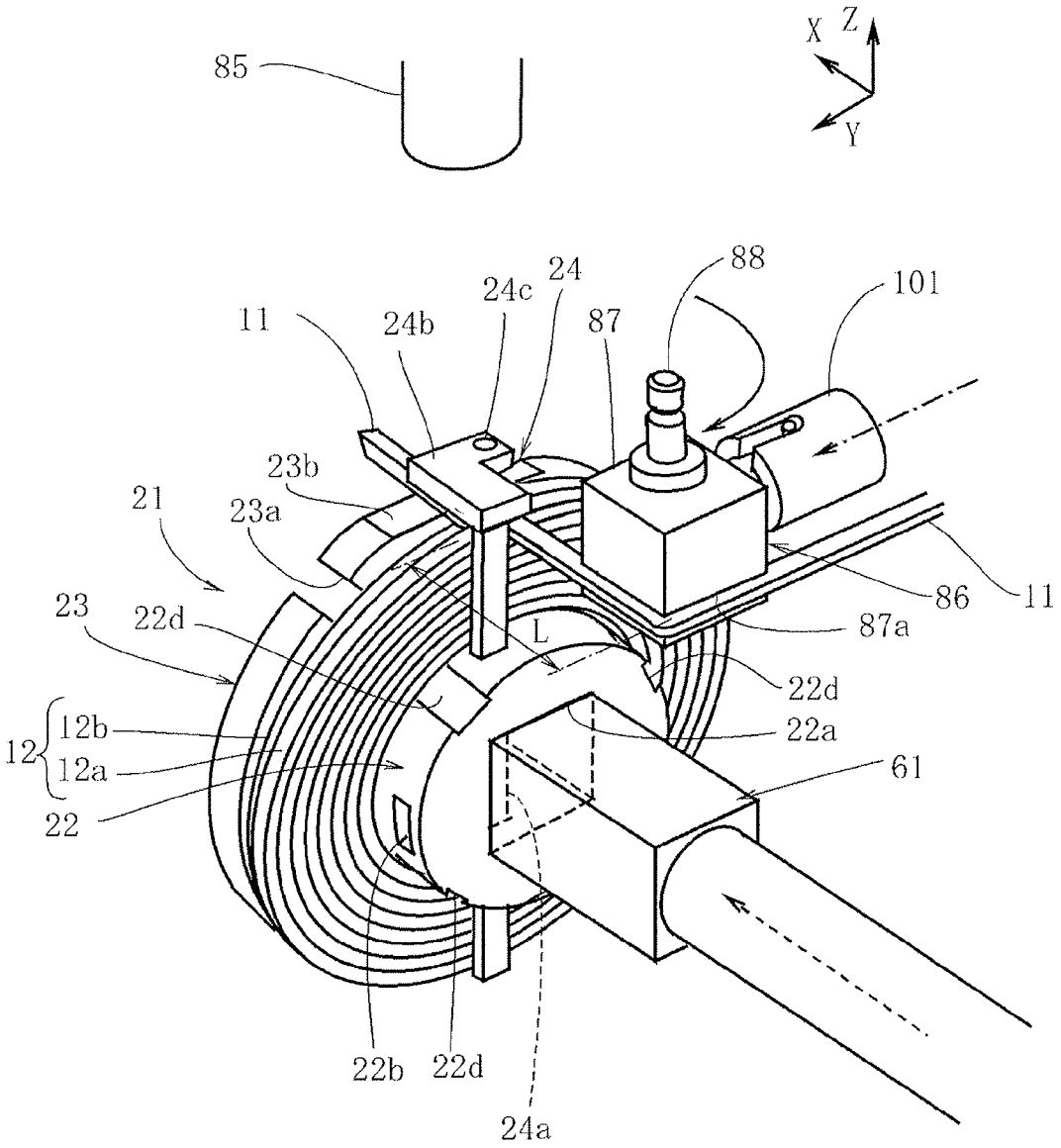
FIG. 19 is a perspective view, corresponding to FIG. 18, showing a state where the wire rod is cranked by pushing out the winding core and moving the locking member.

Further, as shown in FIGS. 19 and 20, the moving mechanism 110 moves the locking member 86 in the Y-axis direction as shown by a dashed-dotted line arrow together with the second lock mechanism 101 as the winding core is pushed in the X-axis direction as shown by a broken line arrow by the pull-out bar 61. Then, the locking member 86 is moved along an arc about the pressing member 24 as shown by a solid line arrow of FIG. 19. Then, the wire rod 11 extending from the α-winding coil 12 to the flyer 41 is bent with the pressing member 24 as a supporting point by the locking member 86 moving along the arc relative to the pressing member 24, and extends in the X-axis direction. That wire rod 11 extending in the X-axis direction is further bent by the locking member 86 to extend toward the flyer 41. Thus, the wire rod 11 extending out from the α-winding coil 12 to the flyer 41 is bent in opposite directions by the pressing member 24 and the locking member 86 to be cranked. Since the locking member 86 is spaced apart from the pressing member 24 by the length L of the connecting wire 12*c* (FIG. 10) (FIG. 18), the length of the intermediate wire rod 11 is substantially equal to the pushed-out amount of the winding core 21, i.e. the length L of the connecting wire 12*c* (FIG. 10) between the α-winding coils 12.

Figure 21:
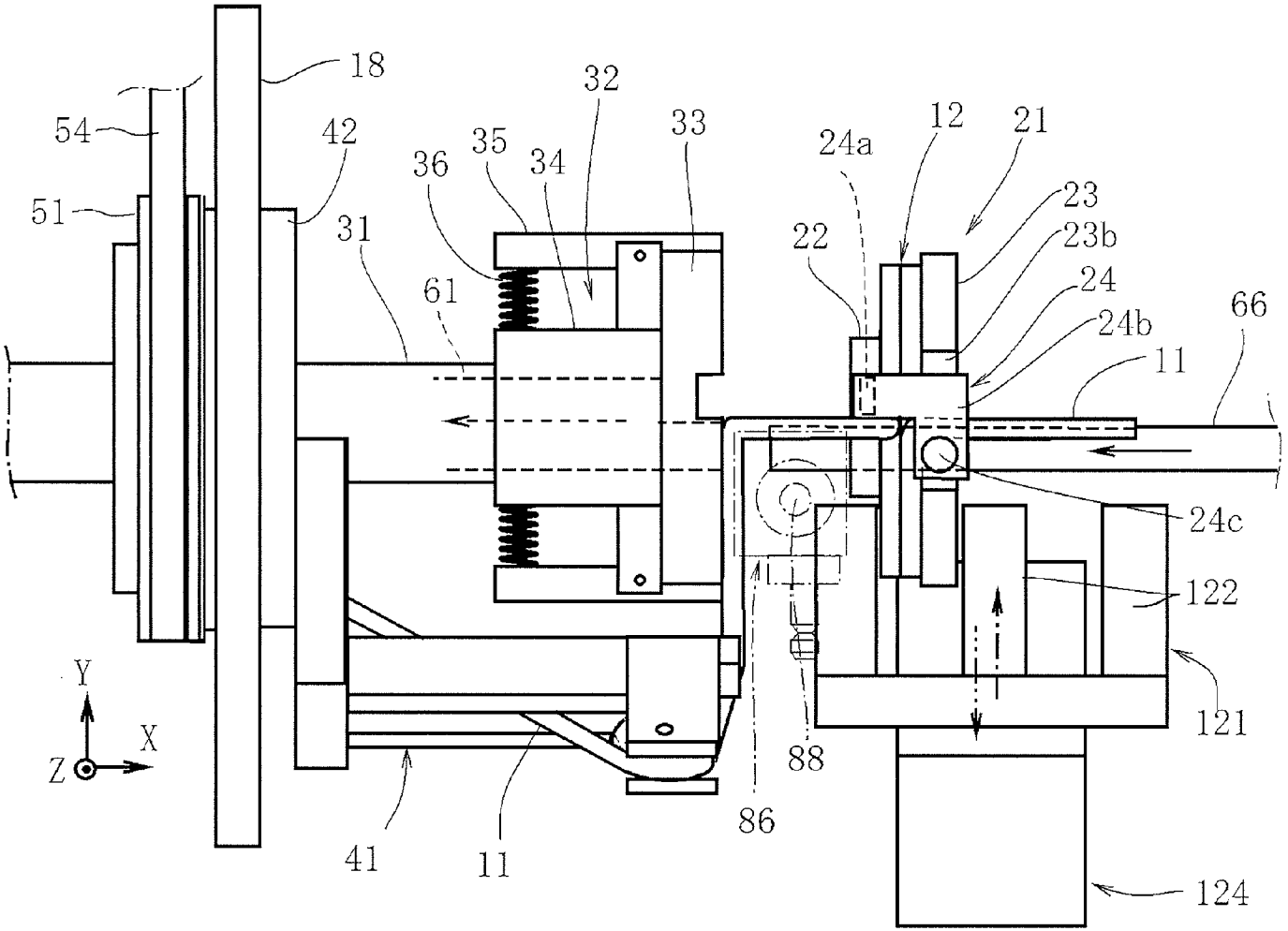
FIG. 21 is a plan view, corresponding to FIG. 13, showing a state where the supporting member is restored together with a pushed out push-out bar.

After the push-out bar 61 is caused to project to remove the winding core 21 from the spindle shaft 31, the push-out bar 61 is pulled back and retracted into the spindle shaft 31 again as shown by a broken line arrow of FIG. 21 by the mover 62 (FIG. 2). As the push-out bar 61 is pulled back, the supporting member 66 is also moved toward the spindle shaft 31 together with the pull-out bar 61 as shown by a solid-like arrow of FIG. 21. The supporting member 66 is moved by driving the servo motor 78 to rotate the screw shaft 74 and moving the supporting member 66 in parallel to the spindle shaft 31 in the direction toward the spindle shaft 31 together with the moving plate 76 threadably engaged with the screw shaft 74 as shown in FIG. 4.

Before both the pull-out bar 61 and the supporting member 66 are pulled back, the comb member 121 is moved in the Y-axis direction toward the supporting member 66 by the fluid pressure cylinder 124. The comb member 121 includes the plurality of inserting members 122 arranged at the desired intervals equal to the lengths L of the connecting wires 12 between the α-winding coils 12 in the multiple-winding coil 10 (FIG. 10) desired to be obtained. Thus, if the comb member 121 is moved as shown by a dashed-dotted line arrow toward the supporting member 66, the winding cores 21 on which the α-winding coils 12 are wound are inserted between the plurality of inserting members 122, thereby being prevented from moving in the X-axis direction.

As shown in FIG. 21, if the both the pull-out bar 61 and the supporting member 66 are pulled back again with the plurality of inserting members 122 inserted between the plurality of winding cores 21, the winding cores 21 are prevented from being pulled back again together with the pulled-back pull-out bar 61 by the comb member 121. The winding core supported on the bar-like portion 61*a* of the pull-out bar 61 is removed from the bar-like portion 61*a* by pulling back the pull-out bar 61 and, instead, the supporting member 66 coaxial with the pull-out bar 61 and moving in the same direction is inserted into the through hole 22*a* of the winding core 21. After the winding core 21 is fitted on the supporting member 66 facing the spindle shaft 31 and the both pull-out bar 61 and the supporting member 66 are completely pulled back in this way, the comb member 121 is separated from the supporting member 66 again as shown by a chain double-dashed line arrow.

Figure 22:
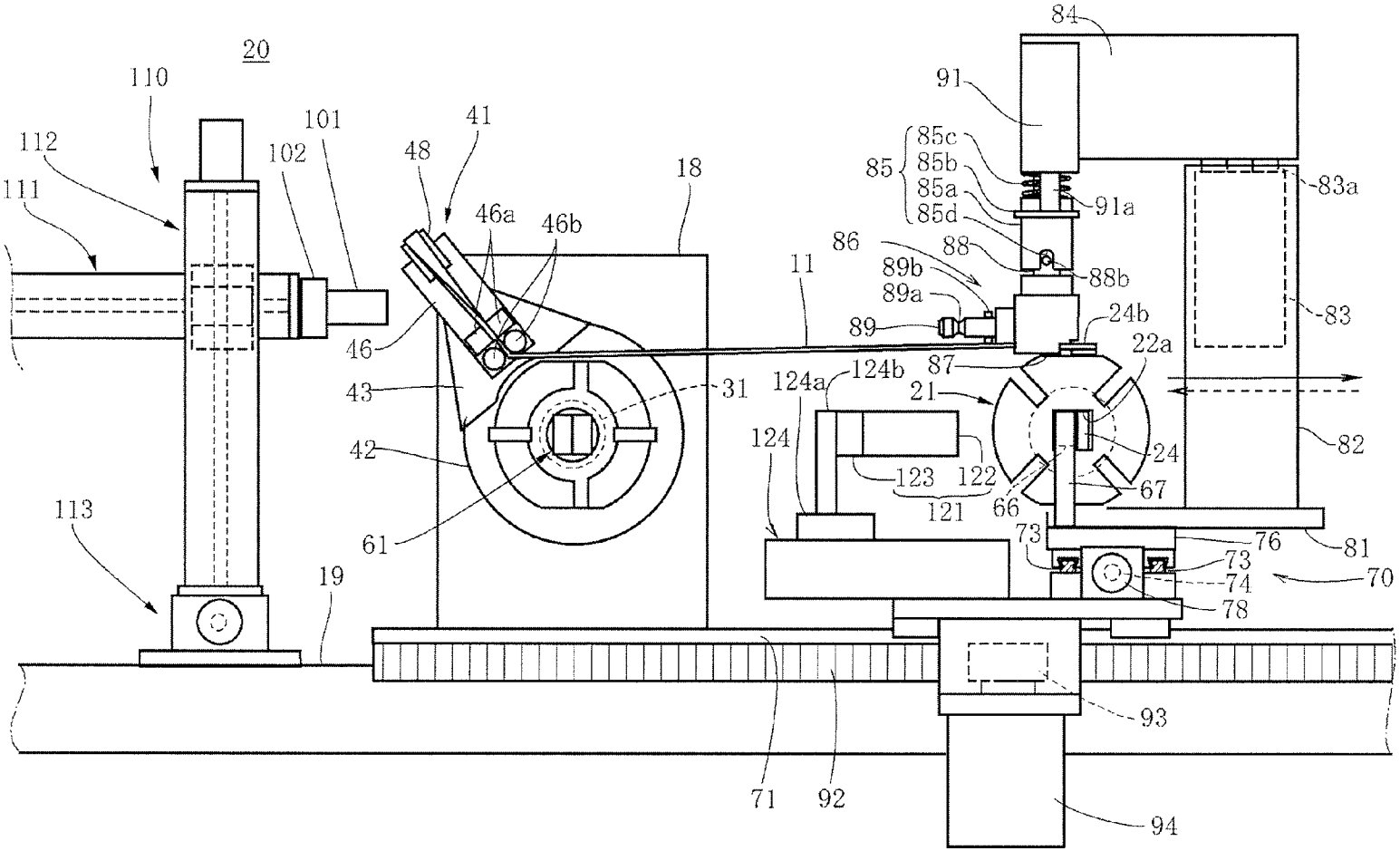
FIG. 22 is a front view, corresponding to FIG. 11, showing a state where the winding core is moved together with the α-winding coil and the wire rod is pulled out from the wire rod feeding flyer.

When the both pull-out bar 61 and the supporting member 66 are completely pulled back, the first lock mechanism 85 moving toward the spindle shaft 31 together with the supporting member 66 returns to the position above the locking member 86 again as shown in FIG. 13. Thus, the locking member 86 is attached to the elevating table 84 via the first lock mechanism 85 again. This transfer is performed in a procedure opposite to that of the aforementioned transfer from the first lock mechanism 85 to the second lock mechanism 101 shown in FIGS. 15 to 17. Thus, although not shown, the rod 91*a* of the operating cylinder 91 is specifically caused to retract to release the first lock mechanism 85 and the elevating table 84 is lowered by the fluid pressure cylinder 83 in that state to fit the first coupling shaft 88 of the locking member 86 into the coupling hole of the first lock mechanism 85. Thereafter, the rod 91*a* of the operating cylinder 91 is caused to project again and the locking member 86 is attached to the elevating table 84 by the first lock mechanism 85. In this state, the second lock mechanism 101 is moved away from the locking member 86 by the moving mechanism 110 to separate the second lock mechanism 101 from the locking member 86. Thereafter, as shown in FIG. 22, the moving mechanism 110 retracts the second lock mechanism 101 separated from the locking member 86 to a position where the second lock mechanism 101 does not obstruct the next winding step. In this way, the removing step is finished.

<Second Pull-Out Step>

In this step, as shown by a solid line arrow of FIG. 22, the winding core 21 removed and supported on the supporting member 66 is moved together with the α-winding coil 12 and the wire rod 11 connected to the α-winding coil 12 is pulled out a predetermined length anew from the wire rod feeding flyer 41. The wire rod 11 is pulled out by moving the movable table 72 in the direction away from the flyer 41. To relatively smoothly pull out the wire rod 11, it is preferable that the flyer 41 is inclined by about 45° or more in the direction away from the locking member 86 with respect to the Z-axis direction by slightly rotating the circular plate 42. Since the wire rod 11 continuous from the α-winding coil 12 toward the flyer 41 is cranked and locked in the locking groove 87*a* of the locking member 86, the wire rod continuous from that part can be fed from the flyer 41 without losing the cranked state by moving the locking member 86 together with the winding core 21. The movement of the movable table 72 is stopped in a state where the wire rod 11 having a length suitable to form one coil of the α-winding coil 12 is pulled out anew. In this way, the second pull-out step is finished.

The multiple winding method for coil according to this embodiment is characterized by forming a desired number of α-winding coils 12 connected to each other by successively repeating the winding step, the removing step and the second pull-out step described above. In the removing step that is repeated, it is characterized to successively support the winding core 21 removed by the winding core removal mechanism 60 facing the spindle shaft 31 at a desired distance from the winding core 21 already supported on the supporting member 66.

Figure 23:
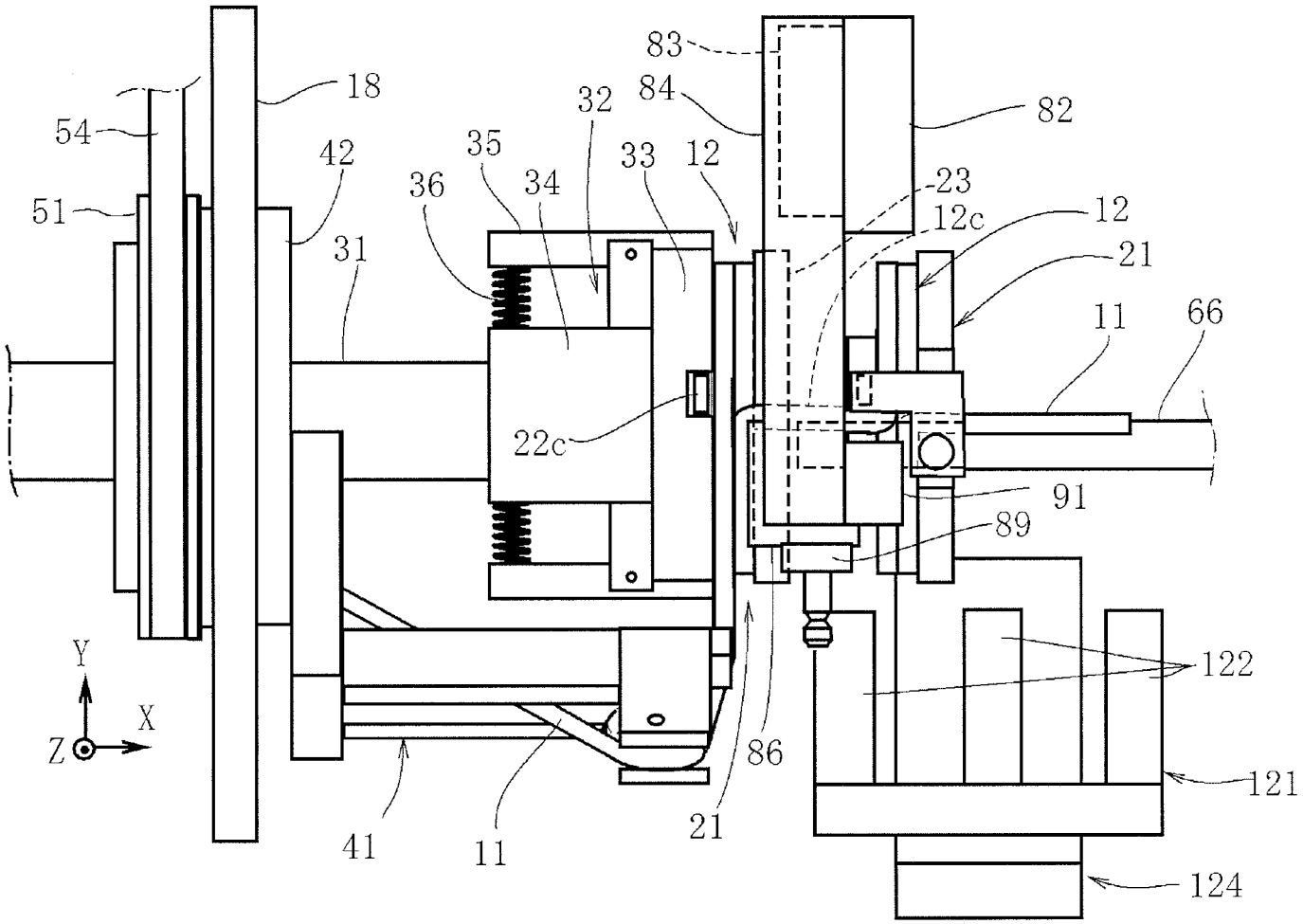
FIG. 23 is a plan view, corresponding to FIG. 13, showing a state where the next α-winding coil is obtained by winding the wire rod on the next winding core.

This is specifically described. In the winding step that is repeated, the winding core 21 is mounted on the tip end of the spindle shaft 31 again and rotated to wind the pulled-out wire rod 11 on the winding core 21, and the wire rod feeding flyer 41 is rotated in the same direction at the rotation speed faster than the rotation of the winding core 21 to wind the wire rod 11 fed from the wire rod feeding flyer 41 on the winding core 21, whereby the α-winding coil 12 is formed. Then, as shown in FIG. 23, the α-winding coil 12 connected to the α-winding coil 12 formed on the winding core 21 previously supported on the supporting member 66 by the connecting wire 12*c* is obtained when the supporting member 66 faces the winding core 21. The winding step that is repeated is finished when the multiple-winding coil 10 is fog died in which the previous α-winding coils 12 and the newly obtained α-winding coil 12 are connected by the connecting wires 12*c*.

Figure 24:
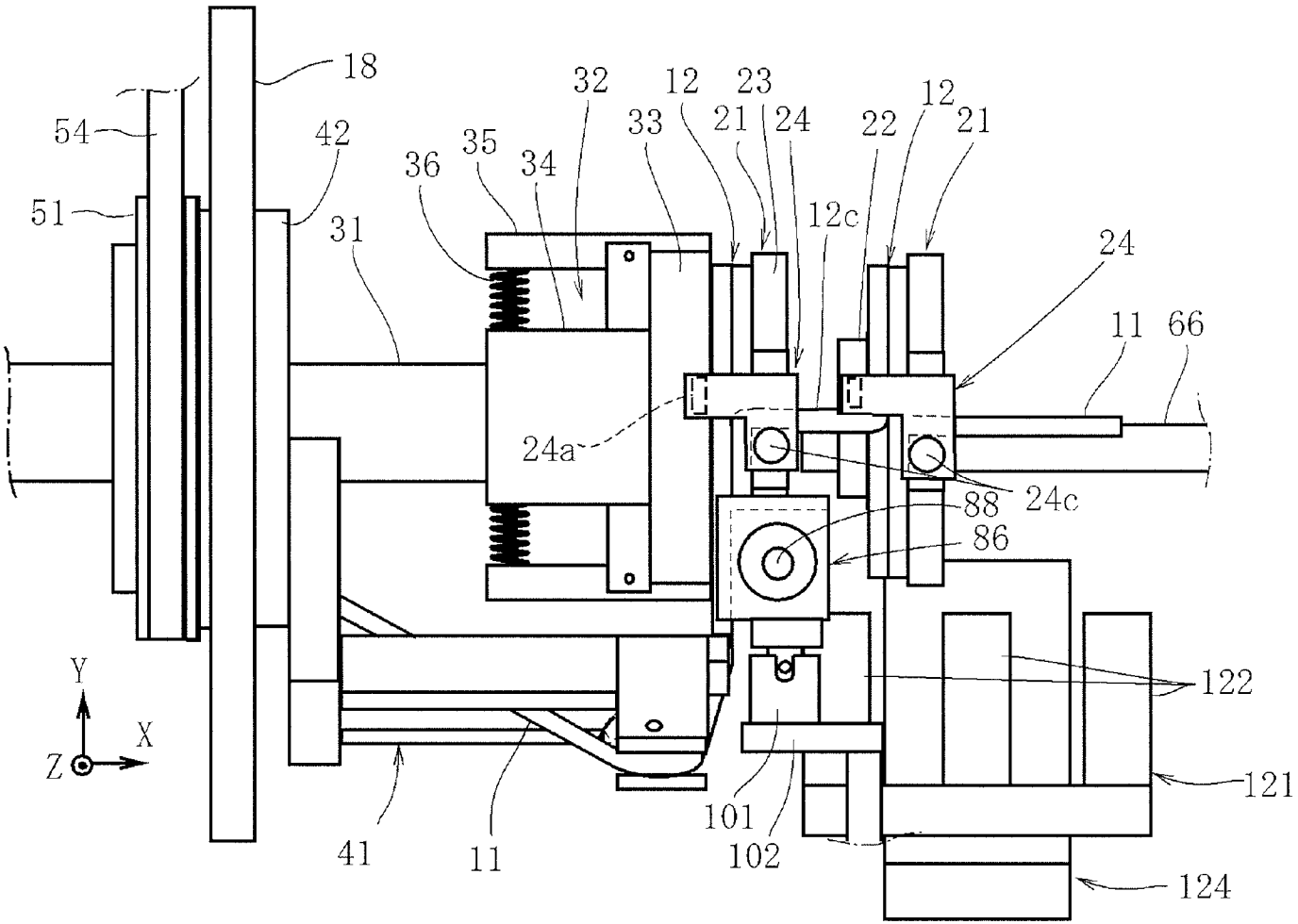
FIG. 24 is a plan view, corresponding to FIG. 14, showing a state where the collapse of the next α-winding coil is prevented by the pressing member.

Next, in the removing step that is repeated, the newly obtained α-winding coil 12 is removed from the spindle shaft 31 together with the winding core 21. In this removing operation, the locking member 86 attached to the elevating table 84 via the first lock mechanism 85 (FIG. 4) is transferred to the second lock mechanism 101 and moved toward the flyer 41 by a distance substantially equal to the length L (FIG. 10) of the connecting wire 12 between the α-winding coils 12 as shown in FIG. 24. Then, the pressing member 24 is inserted into the insertion hole 22*c* of the core main body 22 via the open space above the winding core 21 and a situation where the newly obtained α-winding coil 12 loses its shape is prevented by the pressing member 24.

Figure 25:
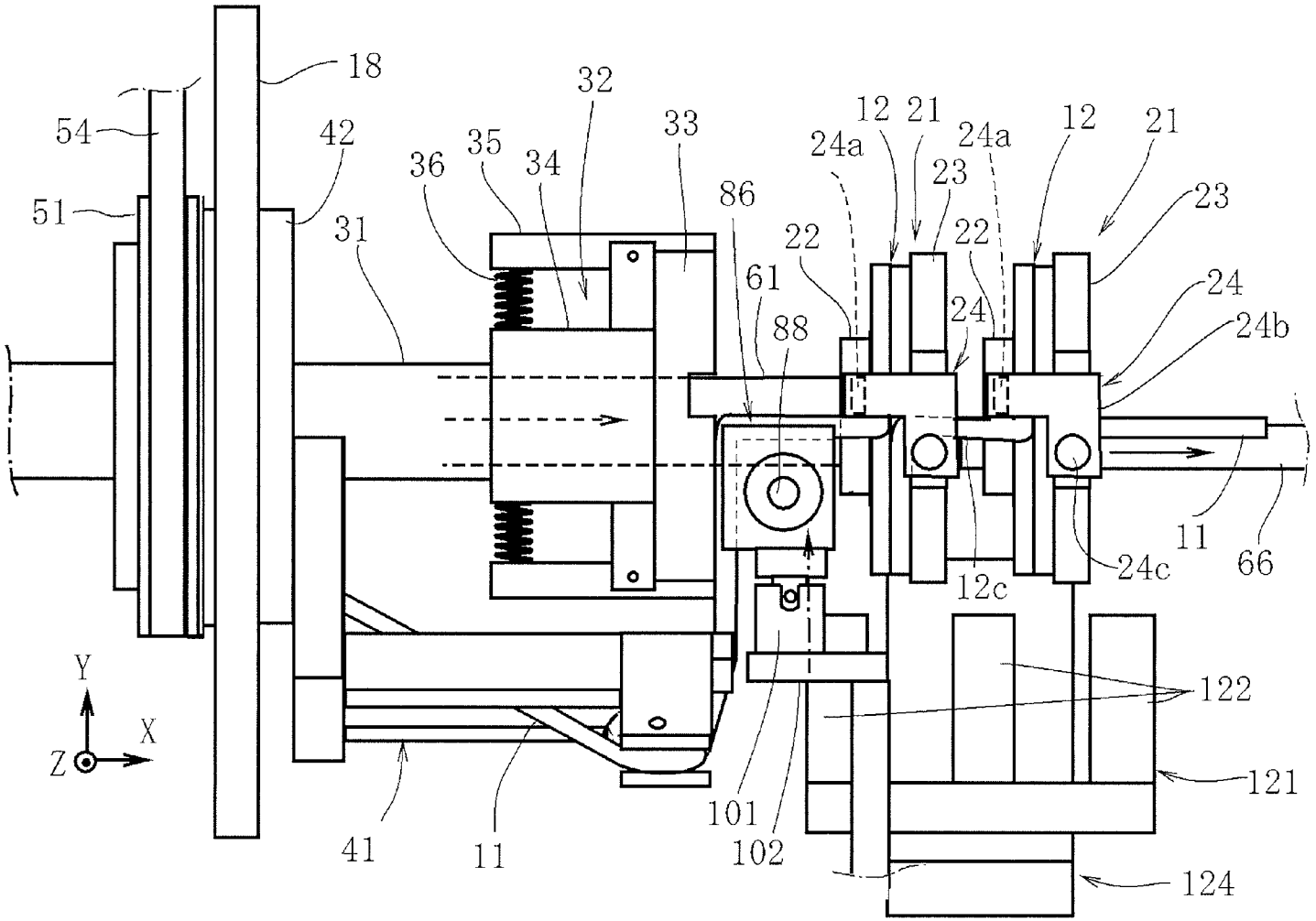
FIG. 25 is a plan view, corresponding to FIG. 20, showing a state where the winding core is pushed out together with the next α-winding coil.

Subsequently, as shown in FIG. 25, the push-out bar 61 is caused to project from the tip end of the spindle shaft 31 as shown by a broken line arrow and the winding core 21 is removed from the spindle shaft 31 and supported on the bar-like portion 61*a*. In synchronization with the projecting movement of the push-out bar 61, the supporting member 66 the tip end of which is facing the bar-like portion 61*a* of the push-out bar 61 is moved in the same direction as the moving direction of the push-out bar 61 as shown by a solid line arrow of FIG. 25. By the movement of the supporting member 66, the winding core 21 already supported on the supporting member 66 moves together with the supporting member 66 and the newly formed α-winding coil 12 is moved again by a length substantially equal to the length L of the connecting wire 12*c* (FIG. 10) between the α-winding coils 12 in the X-axis direction in a state connected to the α-winding coil 12 already supported on the supporting member 66 by the connecting wire 12*c*.

Further, the moving mechanism 110 moves the locking member 86 in the Y-axis direction as shown by a dashed-dotted line arrow of FIG. 25 as the winding core 21 is pushed out by the push-out bar 61, whereby the wire rod 11 extending out from the newly formed α-winding coil 12 toward the flyer 41 is cranked and the length of the intermediate wire rod 11 is set to be substantially equal to the length L of the connecting wire 12*c* (FIG. 10).

Figure 26:
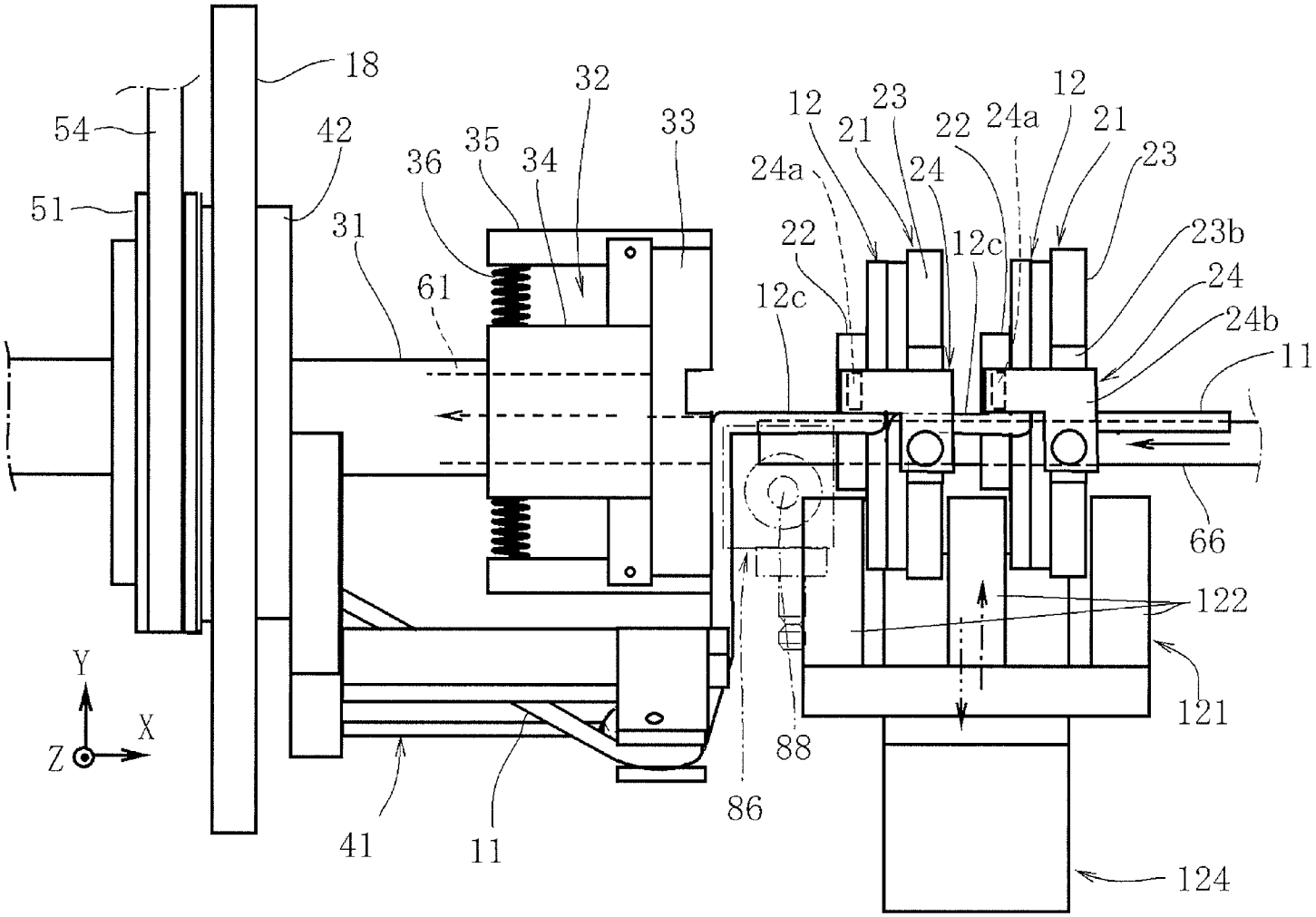
FIG. 26 is a plan view, corresponding to FIG. 21, showing a state where the supporting member is restored together with the pushed out push-out bar.

Subsequently, as shown in FIG. 26, the both push-out bar 61 and the supporting member 66 are pulled back. Before that, the comb member 121 is moved toward the supporting member 66 as shown by a dashed-dotted line arrow by the fluid pressure cylinder 124 and the winding cores 21 on which the α-winding coils 12 are wound are inserted between the plurality of inserting members 122, thereby preventing these winding cores 21 from moving in the X-axis direction. In this state, both the push-out bar 61 and the supporting member 66 are pulled back and the supporting member 66 is inserted into the through hole 22*a* of the winding core 21 on which the α-winding coil 12 is newly formed. Then, both the newly formed α-winding coil 12 and the α-winding coil 12 already supported on the supporting member 66 move on the supporting member 66 while being connected by the connecting wire 12*c*. In this way, the winding core 21 removed by the winding core removal mechanism 60 facing the spindle shaft 31 can be successively supported on the supporting member 66 at a desired distance from the winding core 21 already supported on the supporting member 66.

In this way, after the both push-out bar 61 and the supporting member 66 are completely pulled back, the comb member 121 is separated from the supporting member 66 again as shown by a chain double-dashed line arrow and the locking member 86 is attached to the elevating table 84 via the first lock mechanism 85 again. Then, the second lock mechanism 101, from which the locking member 86 was separated, is retracted by the moving mechanism 110 to the position where the second lock mechanism 101 does not obstruct the next winding step. In this way, the removing step that is successively repeated is finished.

As just described, in this embodiment, a desired number of α-winding coils 12 are formed while being connected to each other by successively repeating the winding step, the removing step and the second pull-out step described above and the winding core newly removed from the spindle shaft 31 is successively supported on the supporting member 66 while being spaced apart by a desired distance from the already supported winding core 21 in the removing step that is repeated. Thus, a moving distance of the winding core 21 in the axial direction by the winding core removal mechanism 60 becomes the length of the connecting wire 12*c* between the α-winding coils wound on the plurality of winding cores 21 supported on the supporting member 66.

Thus, in the multiple winding apparatus 20 and the multiple winding method for coil according to this embodiment, the length of the connecting wire 12*c* can be easily adjusted by changing and adjusting the moving distance of the winding core 21 in the axial direction by the winding core removal mechanism 60. Therefore, if the moving distance of the winding cores 21 in the axial direction by the winding core removal mechanism 60 is made shorter than the outer diameter D of the α-winding coils 12, it is possible to obtain the multiple-winding coil 10 in which the α-winding coils 12 are connected by the connecting wires 12 shorter than the outer diameter of the coils 12.

After obtaining the multiple-winding coil 10 in which the desired number of α-winding coils 13 are connected by the connecting wires 12 having the desired length, the winding cores 21 on which the respective α-winding coils 12 are formed are removed from the α-winding coils 12. The core main bodies 22 can be easily pulled from the α-winding coils 12 by pulling the pressing member 24. Further, since the tape grooves 22*d* are formed on the core main body 22, so-called taping can also be performed by binding the α-winding coil 12 with tapes inserted into the tape grooves 22*d* to prevent the collapse of the α-winding coil 12 at the time of this removing operation. In this way, the multiple-winding coil 10 shown in FIG. 10 is obtained in which the desired number of α-winding coils 12 are connected by the connecting wires 12*c* having the desired length.

The moving mechanism 110 configured by the combination of the X-axis, Y-axis and Z-axis expanding actuators has been described in the embodiment described above. However, the moving mechanism 110 is not limited to the above structure and any fog in may be adopted as long as the second lock mechanism 101 is movable in the three axis directions relative to the mount 19.

Further, the case where the self-fusing wire (so-called cement wire) is used which is a rectangular wire having a rectangular cross-section and includes an insulation coating fusible by hot air or solvent has been described in the embodiment described above. However, the wire rod 11 is not limited to the rectangular wire and the cross-section thereof may be square or polygonal. The wire rod 11 may also be a so-called round wire having a circular cross-section. Further, the wire rod 11 may be a general coated wire having an insulation coating which is not fusible. In the case of using a general coated copper wire, which is not self-fusible, as the wire rod 11, it is preferable to remove the winding core 21 from the α-winding coil 12 after taping is performed via the tape grooves 22*d* to prevent the collapse of the obtained α-winding coil 12. Further, the wire rod 11 may be fixed by an adhesive to prevent the collapse of the α-winding coil 12 without using any adhesive tape.

Further, the case where the winding step and the α-winding coil forming step are simultaneously performed has been described in the embodiment described above. Specifically, in the embodiment described above, the pulled-out wire rod 11 is wound on the winding core 21 by rotating the winding core 21 and the wire rod 11 fed from the wire rod feeding flyer 41 is wound on the winding core 21 by rotating the wire rod feeding flyer 41 in the same direction at the rotation speed twice as fast as the rotation of the winding core 21, whereby the α-winding coil 12 is formed. However, the α-winding coil forming step may be performed after the winding step.

Specifically, initially the winding step is performed by rotating the winding core 21, rotating the wire rod feeding flyer 41 in the same direction at the same rotation speed as that of the winding core 21 and winding the thus pulled-out wire rod 11 on the winding core 21 to form the first coil 12*a*. Thereafter, the α-winding coil forming step is performed by stopping the rotation of the winding core 21, continuing the rotation of the wire rod feeding flyer 41 and winding the wire rod 11 fed from the wire rod feeding flyer 41 on the winding core 21 having stopped rotating to form the second coil 12*b* adjacently to the first coil 12*a*. In this case, the α-winding coil 12 composed of the first and second coils 12*a*, 12*b* is fog hied when the α-winding coil forming step is finished. In this way, the α-winding coil forming step may be performed after the winding step.

Further, in the embodiment described above, a rectangular hole has been illustrated as the through hole 22*a* which is formed in the core main body 22 and into which the push-out bar 61 is to be inserted. However, without being limited to the rectangular hole, the cross-sectional shape of through hole 22*a* may be a square shape, a quadrilateral shape or another polygonal shape or may be a circular shape.

Further, the case where the wire rod 11 is cranked using the block body 87 has been described in the embodiment described above. However, the block body 87 may have any shape as long as the wire rod 11 is cranked and, for example, may be something like a clamp.

Further, the case where the tip ends of the pair of levers 35 are moved away from each other against the biasing forces of the coil springs 36 by the unillustrated operating device provided outside to bring the locking claws 35*a* out of the locking holes 22*b* on the core main body 22 in removing the winding core 21 has been described in the embodiment described above. However, the operating device for this removing operation may be provided on the spindle shaft 31 side. The operating device provided on the spindle shaft 31 side may be an electromagnetic valve or the like provided on the spindle shaft 31 to pivot the levers 35.

Further, the case where the multiple-winding coil 10 is obtained in which four α-winding coils 12 are connected via the connecting wires 12*c* has been described in the embodiment described above. However, the number of the α-winding coils 12 constituting the multiple-winding coil 10 is not limited to four. Thus, a multiple-winding coil 10 in which a relatively large number of winding cores are connected may be, for example, obtained such as a multiple-winding coil 10 in which 10 or 20 α-winding coils 12 are connected by the connecting wires 12*c*. However, a supporting member 66 necessary in the case of obtaining a multiple-winding coil 10 in which a relatively large number of α-winding coils 12 are connected needs to have a length capable of supporting the α-winding coils 12 at desired intervals equal to the length of the connecting wires 12*c* in the axial direction. In other words, a multiple-winding coil 10 in which a desired number of α-winding coils 12 are connected can be reliably obtained by using a supporting member 66 having a length capable of supporting all the α-winding coils 12 constituting the multiple-winding coil 10 desired to be obtained.

This invention is not limited to the embodiment described above, and may be subjected to various modifications within the scope of the technical spirit thereof.

With respect to the above description, the contents of application No. 2012-25628, with a filing date of Feb. 29, 2012 in Japan, are incorporated herein by reference.

What is claimed is:

1. A multiple winding apparatus for coil, comprising:

a winding core;

a spindle shaft on a tip end of which the winding core is removably mounted and which rotates together with the winding core;

a wire rod feeding flyer which feeds a wire rod while rotating around the winding core mounted on the spindle shaft;

a winding core removal mechanism which removes the winding core from the spindle shaft by moving the winding core in an axial direction;

a supporting member which faces the spindle shaft and supports a plurality of winding cores removed by the winding core removal mechanism at desired intervals in the axial direction; and a support member moving mechanism which moves the supporting member supporting the plurality of winding cores from a position facing the spindle shaft in a direction away from the spindle shaft.

2. The multiple winding apparatus for coil according to claim 1, wherein the support member moving mechanism includes:

a movable table provided to be movable in a direction perpendicular to the spindle shaft, and a moving plate provided on the movable table movably in parallel to the spindle shaft; and the supporting member is provided on the moving plate.

3. The multiple winding apparatus for coil according to claim 1, wherein the winding core includes:

a core main body one end of which is mounted on the tip end of the spindle shaft and on an outer periphery of which the wire rod is to be wound, and a first flange portion which is formed on the other end of the core main body; and a second flange portion at a desired distance from the first flange portion to determine winding width of the wire rod to be wound on the core main body is formed on the tip end of the spindle shaft.

4. The multiple winding apparatus for coil according to claim 3, further comprising:

a pressing member which is inserted through the core main body to be perpendicular to an axis of the core main body and with which one widthwise side of a coil made of the wire rod wound on the core main body comes into contact, wherein the second flange portion is formed with a recessed groove for avoiding interference with the pressing member.

5. The multiple winding apparatus for coil according to claim 1, wherein the winding core removal mechanism includes:

a push-out bar inserted into the spindle shaft; and a mover for causing a tip end of the push-out bar to project from a tip end edge of the spindle shaft.

6. The multiple winding apparatus for coil according to claim 1, further comprising:

a comb member which is capable of preventing axial movements of the plurality of winding cores supported at the desired intervals in the axial direction on the supporting member; and a movable mechanism which reciprocates the comb member between a first position where the axial movements of the plurality of winding cores are prohibited and a second position where movements of the plurality of winding cores are permitted.

7. A multiple winding method for coil, comprising:

a first pull-out step of holding and pulling out a wire rod fed from a wire rod feeding flyer a predetermined length;

a winding step of winding the pulled-out wire rod on a winding core by mounting the winding core on a tip end of a spindle shaft and rotating the winding core;

an α-winding coil forming step of forming an α-winding coil by rotating the wire rod feeding flyer in the same direction as the winding core and winding the wire rod fed from the wire rod feeding flyer on the winding core;

a removing step of removing, by a winding core removal mechanism, the α-winding coil from the spindle shaft together with the winding core by moving the winding core in an axial direction; and a second pull-out step of pulling out the wire rod the predetermined length anew from the wire rod feeding flyer by moving the winding core removed from the spindle shaft together with the α-winding coil;

wherein the steps from the winding step to the second pull-out step are, thereafter, repeated; and a plurality of winding cores removed from the spindle shaft are successively supported at desired intervals in the axial direction on a supporting member facing the spindle shaft in the removing step.

8. The multiple winding method for coil according to claim 7, wherein the winding step and the α-winding coil forming step are simultaneously performed; and in the α-winding coil forming step, the wire rod feeding flyer is rotated in the same direction at a rotation speed faster than the rotation of the winding core in the winding step.

9. The multiple winding method for coil according to claim 7, wherein the pulled-out wire rod is inclined in a direction away from the spindle shaft as the wire rod extends away from the winding core along a line perpendicular to a center of rotation of the winding core in the winding step.

10. The multiple winding method for coil according to claim 7, further comprising:

moving the supporting member supporting the plurality of winding cores from a position facing the spindle shaft in a direction away from the spindle shaft.

* * * * *